US010921090B2

(12) United States Patent
Schatz et al.

(10) Patent No.: US 10,921,090 B2
(45) Date of Patent: Feb. 16, 2021

(54) MOUNTING ADAPTER FOR SELF-LOADING FIREARMS

(71) Applicant: HECKLER & KOCH GmbH, Oberndorf (DE)

(72) Inventors: Rudi Schatz, Dotternhausen (DE); Tobias Maier, Hirrlingen (DE); Wilhelm Fischbach, Deisslingen (DE); Frank Kohler, Dornhan (DE); Stefan Doll, Oberndorf (DE); Marc Roth, Oberndorf (DE)

(73) Assignee: HECKLER & KOCH GmbH, Oberndorf (DE)

( * ) Notice: Subject to any disclaimer, the term of this patent is extended or adjusted under 35 U.S.C. 154(b) by 0 days.

(21) Appl. No.: 15/958,779

(22) Filed: Apr. 20, 2018

(65) Prior Publication Data

US 2018/0266789 A1 Sep. 20, 2018

Related U.S. Application Data

(63) Continuation of application No. PCT/EP2016/001780, filed on Oct. 26, 2016.

(30) Foreign Application Priority Data

Oct. 26, 2015 (DE) ..... 10 2015 013 803.0

(51) Int. Cl.
*F41C 23/16* (2006.01)
*F41G 11/00* (2006.01)
*F41C 27/00* (2006.01)

(52) U.S. Cl.
CPC ..... *F41C 23/16* (2013.01); *F41C 27/00* (2013.01); *F41G 11/003* (2013.01)

(58) Field of Classification Search
CPC ..... F41C 23/16
(Continued)

(56) References Cited

U.S. PATENT DOCUMENTS 5,343,650 A 9/1994 Swan
5,590,484 A 1/1997 Mooney et al.
(Continued)

FOREIGN PATENT DOCUMENTS

DE 19709789 12/1998
DE 10036728 2/2002
(Continued)

OTHER PUBLICATIONS

International Searching Authority, "Written Opinion", issued in connection with PCT Patent Application No. PCT/EP2016/001780, dated Jan. 20, 2017, with English Translation, 5 pages.
(Continued)

*Primary Examiner* — Reginald S Tillman, Jr.
(74) *Attorney, Agent, or Firm* — Hanley, Flight & Zimmerman, LLC

(57) ABSTRACT

Example apparatus are disclosed for an adapter to attach at least one device to a self-loading firearm, the adapter comprising a barrel-side section and a receiver-side section adjacent the barrel-side section, wherein the barrel-side section and the receiver-side section extend in a longitudinal direction of the firearm, wherein one of the barrel-side section and the receiver-side section is securable to a retention device on a firearm barrel or a firearm receiver, and wherein the other of the barrel-side section and the receiver-side section can be moveably supported on the firearm receiver or the firearm barrel by a guide that allows for longitudinal movement of the receiver-side section or the barrel-side section with respect to the firearm.

25 Claims, 18 Drawing Sheets

(58) Field of Classification Search
USPC ..... 42/71.01, 72, 124, 90
See application file for complete search history.

(56) References Cited

U.S. PATENT DOCUMENTS

| | | | | |
|---|---|---|---|---|
| 6,694,660 | B1 | 2/2004 | Davies | |
| 6,829,858 | B2 | 12/2004 | Gablowski | |
| 7,905,041 | B1 * | 3/2011 | Davies | F41A 3/66 42/75.02 |
| 8,230,634 | B1 | 7/2012 | Davies et al. | |
| 9,217,615 | B2 | 12/2015 | Lewis et al. | |
| 2005/0241211 | A1 | 11/2005 | Swan | |
| 2006/0010748 | A1 | 1/2006 | Stoner et al. | |
| 2010/0037505 | A1 | 2/2010 | Romer | |
| 2011/0100203 | A1 | 5/2011 | Genes et al. | |
| 2015/0198409 | A1 * | 7/2015 | DeSomma | F41C 23/16 42/71.01 |
| 2016/0003460 | A1 | 1/2016 | Li et al. | |

FOREIGN PATENT DOCUMENTS

| | | |
|---|---|---|
| DE | 10316545 | 10/2004 |
| DE | 10 2005 015 391 | 10/2006 |
| DE | 102005037884 | 1/2007 |
| DE | 10392631 | 11/2012 |
| DE | 10 2013 208 770 | 11/2014 |
| WO | 9707375 | 2/1997 |
| WO | 2006103062 | 10/2006 |
| WO | 2014127505 | 8/2014 |

OTHER PUBLICATIONS

International Searching Authority, "International Search Report and Written Opinion", issued in connection with PCT Patent Application No. PCT/EP2016/001780, dated Jan. 20, 2017, with English Translation, 6 pages.

German Patent Office, "Office Action", issued in connection with German Patent Application No. 10 2015 013 803.0, dated Sep. 7, 2016, with English Translation, 16 pages.

* cited by examiner 35
38
52
37
54
51
33
50
34
44
49
165
37
46
42
40
32
31
25

4a
94
96
101
105
106
104
94
105
115
15

4a
115
103
94
101
104
106
105
96
98
94
95
114
15
95

5
45
35
44
42
14a
19
23
25
3
155
15
14b
14c
14d
15a
15b
15c

123

143
164
34
135
144
145
139
124
125
133

MOUNTING ADAPTER FOR SELF-LOADING FIREARMS

FIELD OF THE DISCLOSURE

This disclosure relates generally to an adapter for a self-loading firearm. This disclosure relates more particularly to a self-loading firearm that is configured for mounting at least one additional device and has two adapter sections extending in the longitudinal direction of the weapon. For example, this disclosure includes a barrel-side section and a receiver-side section.

BACKGROUND

In this disclosure, position references, such as "up," "down," "front," "back," etc. always relate to a firearm held in a normal firing position, in which the bore axis extends horizontally and firing occurs forward away from the marksman.

Adapters for attaching at least one additional device, or additional apparatus, e.g. a laser sight, (night) aiming device, scope, lighting device, bipod, grenade launcher or the like, on a firearm are known in various designs, including Picatinny rails. The last of these frequently extend in a straight line over the hand guard and/or the receiver, and are secured thereon by fastening means, e.g. screws.

Alternatively, it is also known to attach an additional device, in particular a diopter sight, on an additional mounting rail attached to the firearm. Furthermore, receivers made of metal and/or plastic are known.

DE 10 2013 208 770 A1 shows an assault rifle with a U-shaped stock, which is rigidly connected to the receiver via an extended barrel nut, and a sight mount, which extends over the length of the stock and the receiver. The sight mount is connected to the stock over its entire length, such that it reinforces the rigidity thereof, and is attached to the receiver at it rear end via screws.

U.S. Pat. No. 5,343,650 B1 shows an adapter rail permanently attached to the breech-guiding receiver of an assault rifle, which is extended toward the front. A hand guard is provided on this extension, which encompasses the barrel and the gas discharge without contact thereto, and is secured via two connecting yokes at the front of the rail, as well as at the transition of the barrel into the receiver. The adapter rail has a multi-part design at its rear end, and can be retrofitted with different spacers for height adjustment.

DE 103 92 631 B4 discloses a monolithic firearm housing (there called rail platform) for the American M16 assault rifle, which is cut and drilled out of a block. The inserted barrel comprised a separate barrel extension, which attaches and clamps or pins via the firearm barrel laterally penetrating screw and clamping nuts or pins, which results in tensions.

US 2005/0241211 A1 shows a modular adapter system for attaching an additional device to an assault rifle. A Picatinny rail is provided on the upper surface of the receiver, to which a further Picatinny rail is attached, to which in turn, a two-piece hand guard is attached, encompassing the barrel. The upper part of the hand guard is attached to the second Picatinny rail, and covers the barrel in the shape of a semicircle. Receiving grooves are provided on its undersurface, distributed along the covering part of the hand guard, in which bearing profiles of a likewise semicircular lower part of the hand guard are inserted and can be secured.

US 2006/0010748 A1 shows a rail system for attaching an additional device to an assault rifle. The system includes a Picatinny rail extending over the barrel and the receiver, which is attached at its rear end to a further Picatinny rail on the receiver, extending in the longitudinal direction. A hand guard encompassing the barrel is provided on the barrel-side section of the Picatinny rail, which is attached to the Picatinny rail at its upper surface. The barrel region of the hand guard, or the rail, respectively, is attached in the region of a barrel nut that connects the barrel to the breech-guiding receiver by two lateral clamps that are snapped in place on the barrel nut via a spring-loaded locking ring. The lower part of the hand guard is connected to the upper part via hinges and latching fixtures.

U.S. Pat. No. 5,590,484 shows a continuous Picatinny rail, extending over the receiver and the barrel, for attaching an additional device. An integrated hand guard is provided on the front of the Picatinny rail. The Picatinny rail is provided for the American assault rifle M16, among others, and is attached on a barrel bushing to a barrel mount at the front of the receiver, as well as to the gas discharge. The rear part of the Picatinny rail, extending over the receiver, is neither guided laterally, nor attached. The multi-part adapter fixture is designed to adapt to thermal changes in the barrel during sustained firing, and for this reason is not secured in the region of the receiver.

U.S. Pat. No. 6,694,660 B1 shows a hand guard system for assault rifles. A permanently mounted Picatinny rail is provide on the assault rifle receiver. Furthermore, a hand guard is provided on a further Picatinny rail, which is slid onto the receiver-side Picatinny rail, and secured there via perpendicular screws. The barrel-side section encompasses the barrel with a tube-shaped hand guard, without contact thereto. In the assembled state, a cylindrical barrel retention nut with a smooth outer surface serves as a lateral bearing and guide for the hand guard section.

U.S. Pat. No. 8,230,634 B1 shows a Picatinny rail with a single-piece hand guard provided thereon. The Picatinny rail encompasses the breech-guiding receiver with a guide adapted to the contour of the upper part of the receiver, and is secured there in a form-fitting manner to the upper surface of the receiver with connecting elements, e.g. screws. A tube-shaped inner surface of the hand guard is guided by the outer contour of a barrel nut, and the inner hand guard contour is pressed against the outer contour of the barrel nut by means of a clamp and two screws.

DE 100 36 728 A1 by the applicant shows an assembly system for attaching a grenade launcher to the undersurface of a hand guard or the stock of an automatic rifle. The grenade launcher is mounted such that its rear end can move. In order to attach the grenade launcher, the automatic rifle comprises a force-absorbing fixed bearing at basically the same height as a gas intake.

DE 103 16 545 A1 by the applicant shows an adapter for attaching one or more additional devices to a firearm, in particular an automatic rifle. The adapter is secured to a sleeve encompassing the barrel of the firearm, which can be permanently or mechanically connected thereto. The adapter extends exclusively over the barrel of the firearm, and comprises an extension, extending toward the rear, which engages in a complementary recess in the receiver, in order to mount the adapter on the sleeve in a non-rotating manner.

Lastly, DE 10 2005 037 884 B3 by the applicant shows an adapter component for receiving attachments. The adapter component is provided as a hand guard, which has Picatinny rails on its lateral surfaces. The adapter component is slid onto the barrel and the gas discharge mechanism in the assembled state, and secured on the sleeve via a locking pin by means of a force-fitting clamping thereof, such that it cannot move longitudinally. A securing lug engages in a complementary recess in the receiver, and serves to orient and align the hand guard during installation, and also secures the hand guard against rotation.

BRIEF DESCRIPTION OF THE DRAWINGS

FIG. 11 is an enlarged view of a section of FIG. 9*b*.

FIG. 15*e* is a perspective view diagonally from the rear of the insert of FIG. 15*a*.

FIG. 17 is a perspective view of a section of the receiver of FIG. 16 with a second example counter-profile.

DETAILED DESCRIPTION

Figure 1:
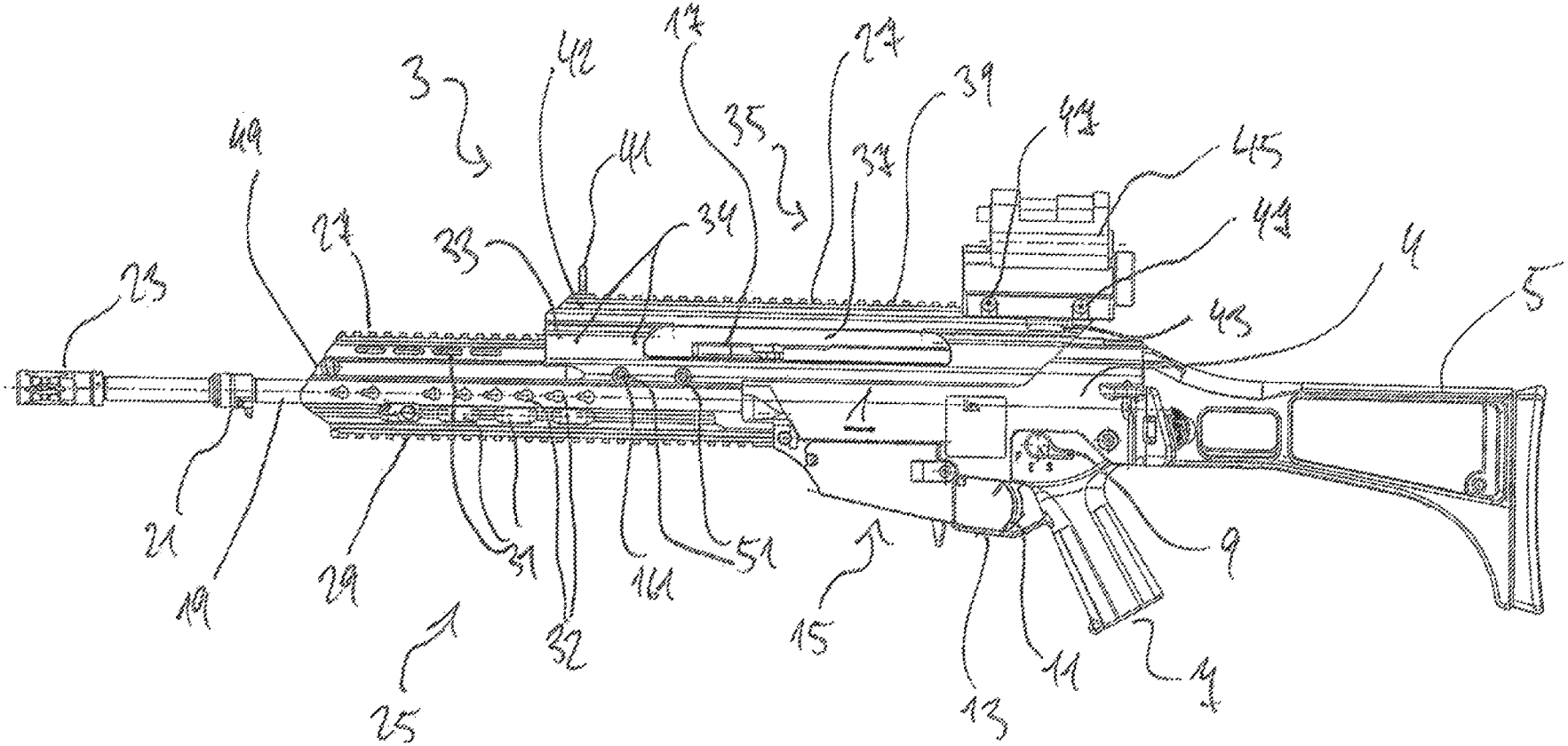
FIG. 1 is a lateral view of an adapter coupled to a self-loading firearm.

The teachings of this disclosure create an alternative adapter and a firearm with such an adapter, which have a simple structural design, and ensure the functionality of the at least one additional device attached thereto.

A generic firearm disclosed herein is distinguished in that it is provided with the adapter, wherein the firearm has a retention device coupled to one of the barrel-side section or the receiver-side section to secure the adapter, and wherein a floating bearing is coupled to one of the barrel-side section or the receiver-side section to allow longitudinal displacement of the adapter with respect to the firearm.

The adapter according to this disclosure and the associated firearm ensure the functionality of the at least one additional device attached thereto, in particular a sight. When the barrel radiates heat to the receiver, e.g. during sustained firing, and the receiver expands or becomes distorted as a result, as can happen in particular with plastic receivers, or when the barrel itself becomes thermally distorted, the additional device remains—due to the special adapter bearing—substantially protected from the tensions arising thereby. If the additional device is a sight, for example, the targeting position is altered very little or not at all when the barrel becomes hot. The floating bearing allowing for longitudinal movement compensates for any axial displacements in relation to the fixed bearing.

The adapter is fixed (secured) longitudinally to the retention device on the barrel, in particular in the proximity of the barrel nut. The part of the barrel vibrating least while shooting is located in the region of the barrel nut. The barrel-side adapter section then encompasses the barrel without contact thereto.

As a result of the longitudinal displacement capacity, a stable mounting of an additional device mounted on the adapter is ensured, in particular a scope, targeting aid, or sight, independently of potential movements of the breech-guiding receiver.

The adapter can have multiple components. The barrel-side section and the receiver-side section are unitary (e.g., an integral design), and the barrel-side section can be secured to the firearm barrel, and wherein the receiver-side section can be supported on the firearm receiver to allow longitudinal displacement. The integral design is easy to obtain in terms of production technology, and eliminates additional components and attachment elements. Because the floating bearing for the adapter is mounted on the receiver such that it is secured laterally, but can move longitudinally, an alignment is ensured that remains unaffected by different heat expansion coefficients of the receiver (and/or the barrel) and the scope mount, or the adapter. On the whole, a good shooting precision, even in sustained firing, and when the barrel has become hot, can be ensured by the moving guidance of the floating bearing on the receiver.

The barrel-side section can be designed as a rail. The barrel-side section at least partially encompasses the firearm barrel as a hang guard, and the receiver-side section at least partially covers an upper surface of the receiver.

This measure eliminates the need for an additional hand guard. "Encompass," as set forth in this disclosure, means that the receiver-side section thereof is designed at least in part with sections that are complementary to the surface of the receiver, such that it can simply be slid onto the receiver during assembly, and is securely supported on the receiver. The receiver thus forms an additional guidance during assembly, and increases the stability.

After assembly of the adapter of the firearm, the barrel-side section extends along the barrel from proximity of a gas discharge to the receiver and encompasses the firearm barrel without contacting the firearm barrel. This measure ensures, among other things, that the hand guard remains unaffected by vibrations, in particular in the front region of the barrel, because it is spaced apart therefrom.

The receiver-side section comprises one or more grooves on at least one of an upper surface or a lateral surface of the receiver-side section, and wherein a Picatinny rail at least partially forms an under surface of the barrel-side section.

The formation of only a few grooves is simple and inexpensive. The respective attachment grooves can thus be easily aligned with the additional device that is to be attached. The remaining lateral surface can be smooth.

A Picatinny rail at least partially forms at least one of an upper surface or a lateral surface of the receiver-side section, and wherein a Picatinny rail at least partially forms an under surface of the barrel-side section. This measure increases the flexibility when attaching different additional devices, because these can be variably mounted in different positions on the respective Picatinny rails. Additional lateral Picatinny rails further increase the flexibility, because additional devices can also be mounted on the respective adapter, surrounding it in the manner of a crown, if necessary.

The adapter can be designed as a straight, horizontal rail. The barrel-side section transitions into the receiver-side section via at least one lateral bridge section, and wherein the at least one lateral bridge section is a stepped section. Such a bridge construction of the adapter, in particular a symmetrical construction, ensures a stable bearing of the scope or sight mounted on the adapter. A stepped design, increasing toward the receiver, conforms in particular to weapon-specific designs for an assault rifle, e.g. rifle G36 by the applicant.

The barrel-side section and the receiver-side section comprise one or more holes (e.g., passages) on a first lateral surface and a second lateral surface opposite the first lateral surface, and wherein the one or more holes are for inserting attachment means. The passages can be recesses, cut-outs, and/or bores. The attachment means are inserted therein in the known manner. Spring-loaded bolts, pins or screws, or other suitable attachment means can be provided for this. If screws or threaded pins are used, these can engage in the known manner in a counter-thread provided opposite.

The barrel-side section and the receiver side section comprise one or more lateral holes, which may be rectangular or oval, for example. They can also be designed as so-called "keyholes." This allows for a ventilation of the barrel, and in particular a heat dissipation outward from the barrel after firing. An additional device or targeting aid can also be attached thereto.

At least one of the barrel-side section or the receiver-side section comprises one or more projecting extensions (e.g., guide elements) on a rear surface to guide, center and secure the adapter on the firearm. The guide element can be designed in particular as a projecting extension, lug, pin, or suchlike.

The projecting extension of the receiver-side section comprises a dovetail profile. The dovetail profile servers to optimize the floating bearing. In particular when the dovetail profile is provided on the receiver-side section of the adapter, which encompasses the receiver, this dovetail profile ensures that the adapter is laterally fixed but can move longitudinally in relation to the receiver. The dovetail profile is the sole contact surface between the adapter and the breech-guiding receiver, and is preferably provided for reducing elastic movements on the receiver to as little or small as possible.

The receiver-side section comprises one or more longitudinal recesses on a first lateral surface and a second lateral surface to actuate a reloading lever. The receiver-side adapter section preferably encompasses the breech-guiding receiver such that symmetrical recesses for actuating a loading lever of the fire arm are provided in both sides of the receiver-side section of the adapter. With this measure, the adapter can encompass the receiver to a large extent, thus increasing the stability of the adapter and simplifying its installation, while also ensuring the functionality of the loading lever and the operability of all of the essential elements.

The receiver-side section comprises one or more recesses to support at least one adjustable sight, and wherein the at least one adjustable sight is at least one of a flip-up rear sight assembly or a flip-up peep sight. Such a recess is preferably provided in particular at the front or rear end of either a Picatinny rail or a rail without grooves, in order to provide a sufficiently long sighting line. Recesses can also be easily milled in terms of production technologies. Furthermore, such a flip-up sight can be folded down when attaching an additional device, such that the installation thereof is not impaired.

The adapter can fully cover the barrel in the region of the hand guard, and can have a closed integral design.

The barrel-side section comprises a cover pivotable between an open position and a closed position about a hinge axis. This measure allows for easy access for removing, inspecting, or cleaning a gas piston and a piston rod of a gas-operated reloading mechanism. The cover can be pivotally supported via a hinge pin through appropriate holes on the lower part of the barrel-side section.

The adapter comprises an insert coupled to the at least one lateral bridge section to stabilize and reinforce the adapter.

The applicant reserves the right to apply for independent protection for this insert.

The stability of the adapter can be increased with this measure. The insert component can also extend thereby beyond the bridge sections. In order, however, to keep the weight of the adapter within limits, the insert component is preferably provided in the region of the bridge sections. In a simple embodiment, the insert component can be configured as a block.

The insert comprises an elastic element, wherein the elastic element comprises a latching lug to secure the cover to the insert. When installing the insert between the bridge sections, the cover can be oriented such that it is closed toward the receiver-side section, and is thus simply pressed by the user via the latching lug, such that it is held away from the elastic element in its snapped-in position. When opening the cover, it can be easily opened upward with a light counter-pressure applied to the latching lug.

The elastic element is provided integrally with the insert, wherein the elastic element is one of a molded spring or a separate component. Alternatively, it can also be a separate component, which is installed in a manner corresponding to its use. An integral design is easy and inexpensive to produce. The insert component can be molded from plastic, wherein the integrated spring made of plastic can also be produced thereby. On the whole, the shape and selection of material can be suited arbitrarily to the insert and its spring.

The insert comprises at least one of a longitudinal gas piston rod guide or a bearing to support a gas piston rod spring. The insert can be secured in the region of the bridge sections. It can have holes for this, in particular aligned with the holes in the adapter, and can be secured there via transverse pins or bolts, or even screws, in some cases, or other appropriate attachment means.

A rear surface of the insert comprises at least one guide element to guide and center the insert on a receiver during assembly. This measure provides for a simple assembly, and ensures a precise positioning of the adapter and the gas piston guide potentially provided therein. The guide element can be a guide lug, for example, or another extension, and extends toward the receiver when the adapter is slid on and snapped in place, and engages in a recess on the front of the receiver when installed. If there is a gas piston, the guide lugs, or the guide element, ensure that the gas piston guide is extended in the receiver.

The retention device is one of a sleeve or an integral sleeve-like extension section of a barrel nut, wherein the sleeve is securable to the barrel-side section in a region of the barrel nut. A sleeve can be permanently secured to the barrel thereby, in particular at its rear region in the proximity of the barrel nut. A transverse groove, for example, can be provided for this on the barrel, such that the barrel sleeve can be secured via a tangential pin or bolt on the barrel.

The sleeve can have transverse grooves on its upper surface for attaching the fixed bearing of the adapter. Alternatively, the retention device can also be provided as an extended barrel nut, which is extended over a sleeve-like section. Circumferential annular grooves could then be provided in the sleeve section, which provide for a form-fitting securing of the adapter in the longitudinal direction via transverse screws, and a force-fitting securing in the lateral direction.

The receiver-side section comprises at least one counter-profile to receive at least one of the guide or an insertion element of the adapter. A complementary counter-profile facilitates the orientation and alignment of the respective guide element and thus the adapter or insert component.

The at least one counter-profile is complementary to a dovetail profile of an extension, wherein the extension comprises a bearing to allow longitudinal movement of the extension with respect to the firearm.

A dovetail profile enables a connection with only a small connecting surface. In order to further reduce the contact points in the dovetail guide, the counter-profile can also be provided as a separate component, attached to the receiver in a suitable manner. The counter-profile can be made of plastic or metal, or a plastic/metal composite. The counter-profile may be spherical, in order to reduce the contact points, which can further reduce receiver effects.

The counter-profile in which the dovetail profile of the adapter engages can be wedge-shaped or slotted, such that a nearly linear guidance further reduces the contact surface.

The construction of the adapter 3 according to this disclosure shall first be explained on the basis of FIGS. 1 and 2. FIG. 1 shows a self-loading firearm 1 with an adapter 3 according to this disclosure mounted thereon, and FIG. 2 shows the adapter 3 alone. The mounting of the adapter 3 on the self-loading firearm 1 and the associated relevant shall be explained in reference to FIGS. 2-12*b*. FIGS. 13-17 show further details of the adapter 3.

FIG. 1 shows a side view of an example self-loading firearm 1, specifically the known assault rifle G36 by the applicant. The self-loading firearm 1 includes an adapter 3 according to this disclosure, and a receiver 4, which has a pivotal shoulder rest 5 at its rear end. A handle 7 is attached to the bottom of the receiver 4, which has a known firing mode selector/safety lever 9 on its upper end. A trigger is disposed in front of the handle 7 in a trigger guard 13. A magazine receiver is provided adjacent thereto. Furthermore, there is a reloading lever 17 on the receiver, for reloading and closing the breech. Moreover, the self-loading firearm comprises a barrel 19, which has a receiver 21 for a bayonet or a grenade launcher attachment (not shown), and which has a flash suppressor 23 at its muzzle.

The adapter 3 is provided on the self-loading firearm 1 for attaching at least one additional device, e.g. a diopter sight, laser range finder, lighting device, bipod, etc. The adapter 3 comprises a barrel-side section 25 and a receiver-side section 35.

The barrel-side section 25 of the adapter 3 encompasses the barrel 19. This barrel-side section 25 comprises a Picatinny rail 27, 29 on both its upper surface and its lower surface, and longitudinal holes 31 and "keyholes" 32 on both sides, which serve to dissipate heat and cool the barrel, or for attaching targeting aids.

The barrel-side section 25 of the adapter 3 transitions in a stepped manner, via a bridge section 33 at its upper, rear end, into the receiver-side section 35. The receiver-side section 35 extends longitudinally and has a Picatinny rail 39 on its upper surface. Alternatively, this rail section can also have no, or only a few, grooves 38 and webs. A flip-up peep sight assembly 41 is provided on the front end of the Picatinny rail 39, above the bridge section 33, which can be pivoted up to a perpendicular position, or down, toward the front, via a spring-locking mechanism (not shown), as desired.

There are two holes 51 in the region of the bridge section 33 for the insertion of attachment means, i.e. screws, bolts, or pins 161, for securing the adapter 3 to a retention device on the barrel 19. Below the Picatinny rail 39, at approximately the height of the reloading lever 17, recesses 37 extend longitudinally on both sides, which enable an actuation of the reloading lever 17.

An optical sight 45 (e.g., a diopter sight) is secured to the Picatinny rail 39 via bolts or tangential pins 47 at the rear end of the receiver-side section 35 of the adapter 3, wherein, alternatively, tension bolts or other suitable attachment means may be provided. A bearing insert 43 for a further sight, such as a flip-up sight, is provided below the optical sight 45.

Figures 2A, 2B:
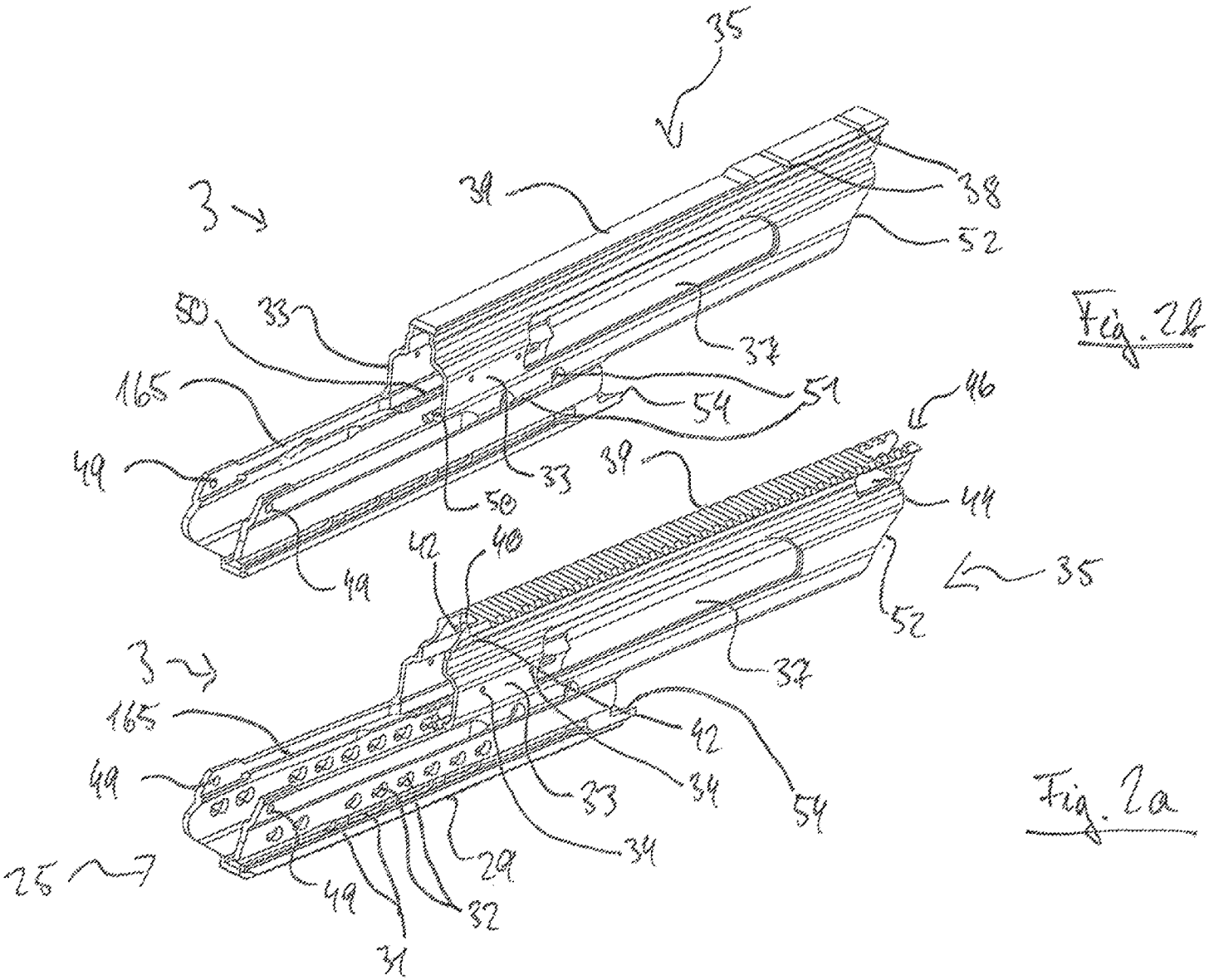
FIG. 2*a* is a perspective view diagonally from the front above of the adapter of FIG. 1.
FIG. 2*b* is a perspective view diagonally from the front above of an alternative adapter.

FIGS. 2*a* and 2*b* show the adapter 3 and differ in that in FIG. 2*a*, the Picatinny rail 39 on the upper surface of the receiver-side section 35 and the Picatinny rail 29 on the undersurface of the barrel-side section 25 of the adapter are Picatinny rails 29, 39. In the embodiment according to FIG. 2*b*, the two Picatinny rail sections 29 and 39 each comprise only two grooves 38 (e.g., transverse grooves) for attaching an additional device on the rear ends of the Picatinny rail section 39. Furthermore, "keyholes" 32 are provided in the embodiment according to FIG. 2*a*.

A recess 40 (e.g., a hole) is provided in the Picatinny rail 39 at the front end of the receiver-side section 35, for receiving a bearing (cf. FIGS. 15*a*-15*e*), for the flip-up sight assembly 41. Furthermore, two holes, or bores 42, pass through the adapter 3 for supporting the flip-up sight 41. There is a recess 46 at the rear end of the receiver-side section 35 for a flip-up rear sight assembly 48, as well as two lateral, parallel holes 44 for receiving a bearing for the flip-up rear sight assembly 48. The bearing 43 can be inserted laterally, for example, and attached with suitable means.

There are two holes 51 for tangential pins or attachment bolts or tension pins 161 or other suitable attachment means for attaching the adapter 3 to a barrel-side retention device, such as a sleeve 79, or a sleeve section 89, on the front, lower side of the barrel-side section 25 in the region of the bridge section 33 (cf. FIGS. 4*a* and 4*b*, 9*a* and 10*a*). Two parallel rails 50 extend longitudinally above the holes 51 on the receiver-side section 35, in the interior thereof (cf. FIG. 2*b*), which serve for the insertion and securing of an insert component (cf. FIGS. 13*a*-13*b* and 15*a*-15*d*).

Figures 6A, 6B:
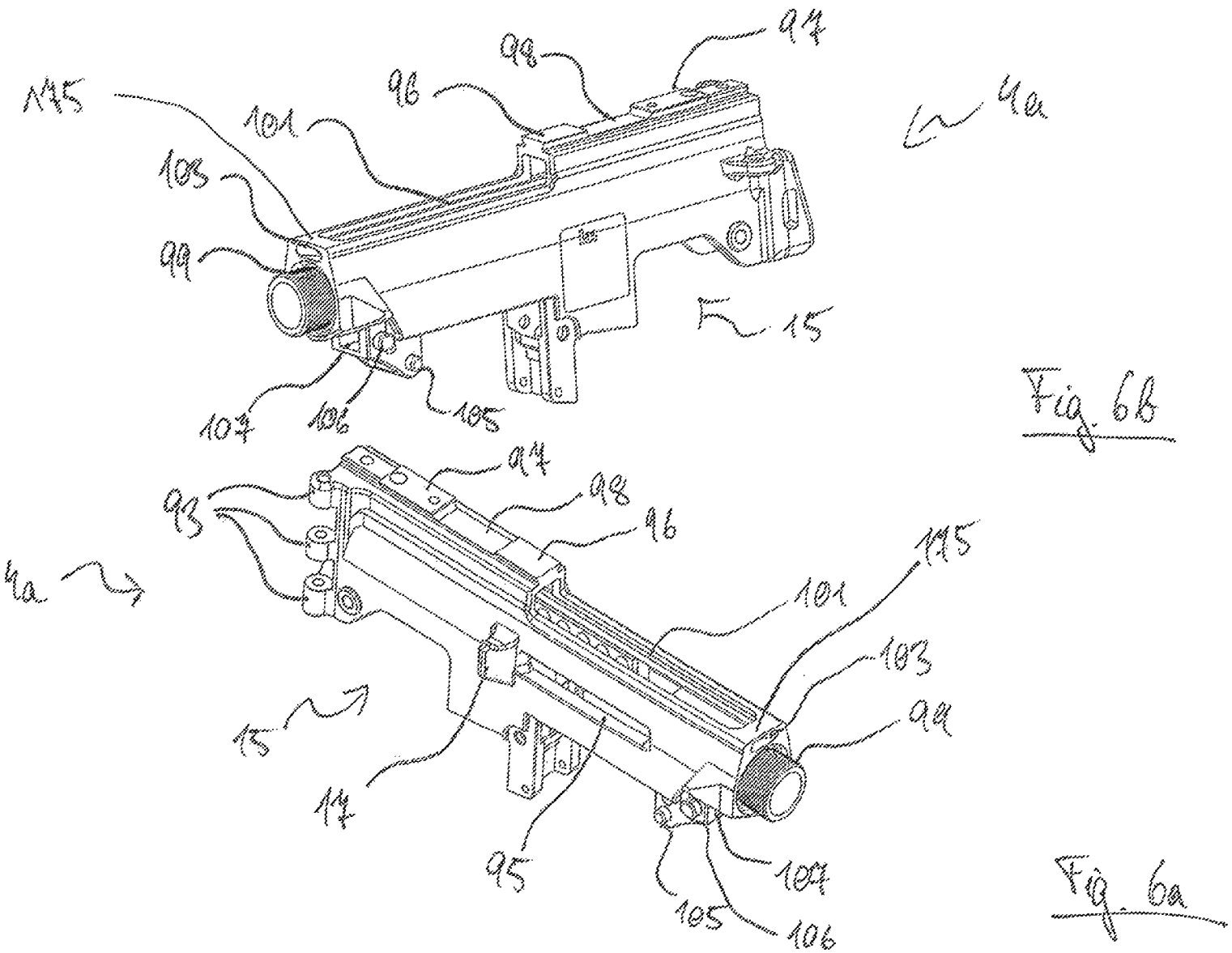
FIGS. 6*a*-6*b* are perspective views of a firearm receiver section.

A parallel extension 54 is provided at the rear end of the barrel-side section 25 of the adapter 3, which centers the adapter 3 when it is mounted on the receiver 4 (cf. FIGS. 6*a* and *b*). Furthermore, there are holes 49 for receiving a bolt or hinge pin 119 on both sides of the upper front surface of the barrel-side section 25 of the adapter 3, which pivotably receive the cover 110 on the adapter 3 (cf. FIGS. 12*a* to 14). The barrel-side section 25 fully encompasses the barrel 19 with a U-shape, and the cover 110 placed thereon.

Figure 3:
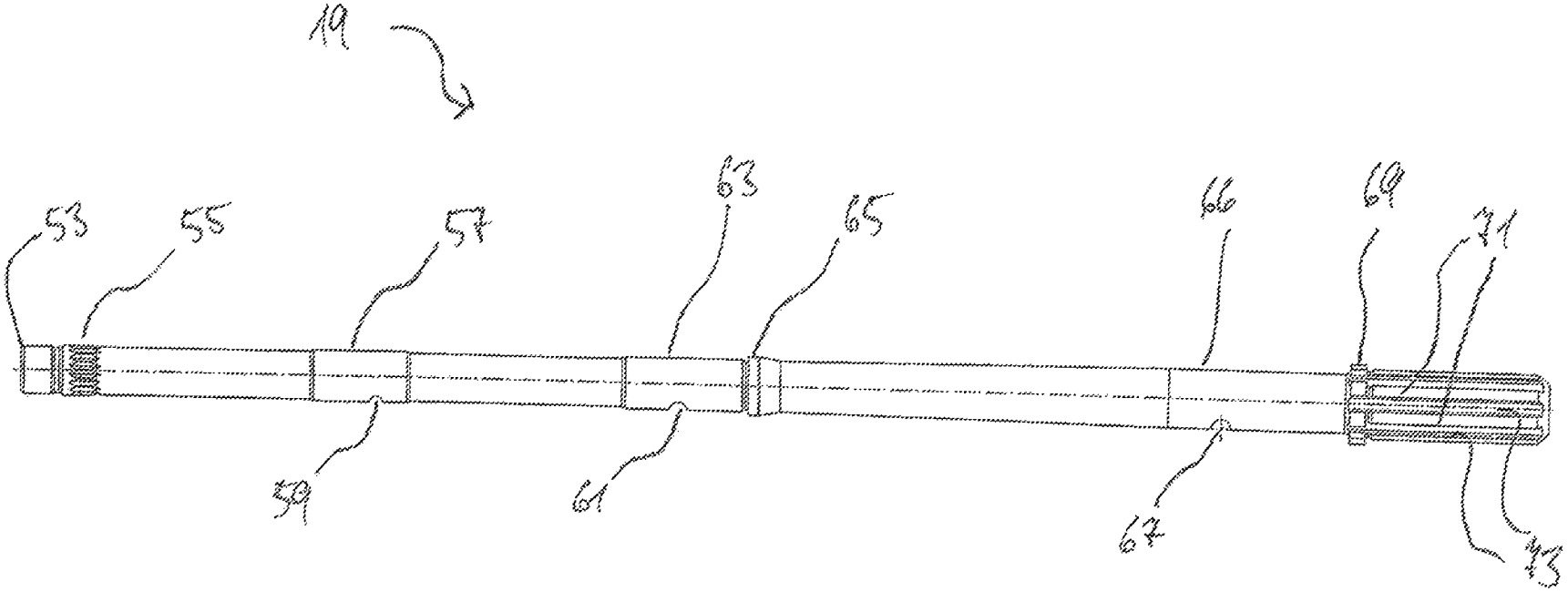
FIG. 3 is a lateral view of a barrel of the self-loading firearm of FIG. 1.

FIG. 3 shows a side view of the barrel 19. Adjoining the muzzle 53, there is counter-bearing section 55 for securing the flash suppressor 23, e.g. via a pin or tension bolt (not shown). At a spacing thereto toward the receiver, the barrel 19 comprises a bearing section 57, which has a groove on its undersurface for securing a receiver 21 of a bayonet or grenade launcher attachment, e.g. via a tangential pin or clamping bolt. A further cylindrical bearing section 63 for attaching a gas discharge 62 is provided in approximately the middle of the barrel 19 (cf. FIGS. 4*a* and *b*). A groove is likewise provided here on the undersurface for securing the gas discharge 62 by means of a tangential pin or bolt, and a collar 65 is provided at the rear end of the bearing section 63, against which the gas discharge 62 bears. A further cylindrical section 66 is provided for a sleeve 79 for attaching the adapter 3 to the barrel 19. A groove 67 for receiving a tangential pin for securing the sleeve 79 is also provided here in the undersurface of the barrel 19. A barrel collar 69 adjoins the rear end of the bearing section 66. The end of the barrel facing the receiver 4 is provided with relief grooves 71 and webs 73 lying therebetween, which extend parallel to the bore axis of the barrel 19.

Figures 4A, 4B:
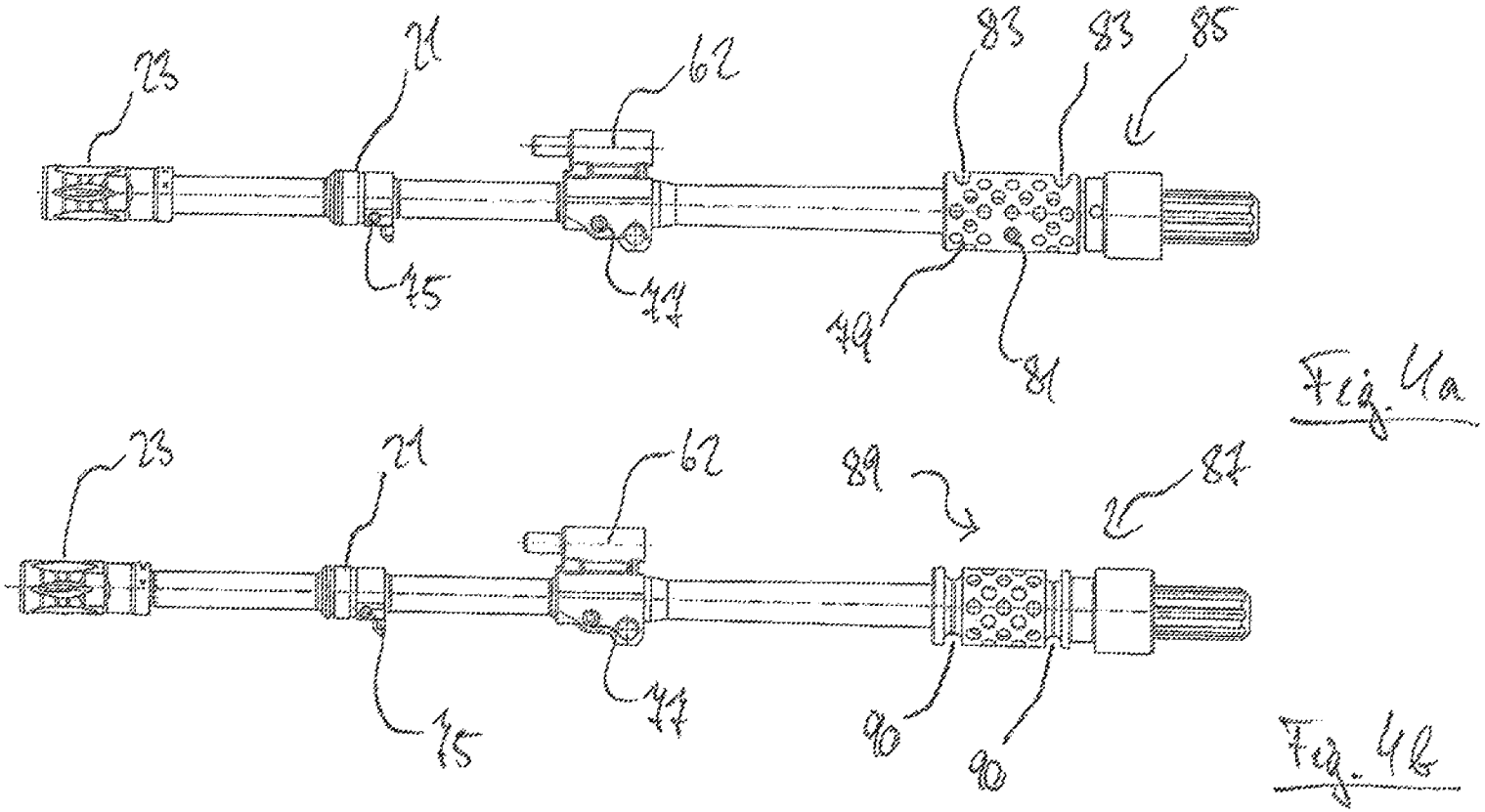
FIG. 4*a* is a lateral view of the barrel of FIG. 3 with additional elements.
FIG. 4*b* is a lateral view of an alternative barrel.
Figure 5:
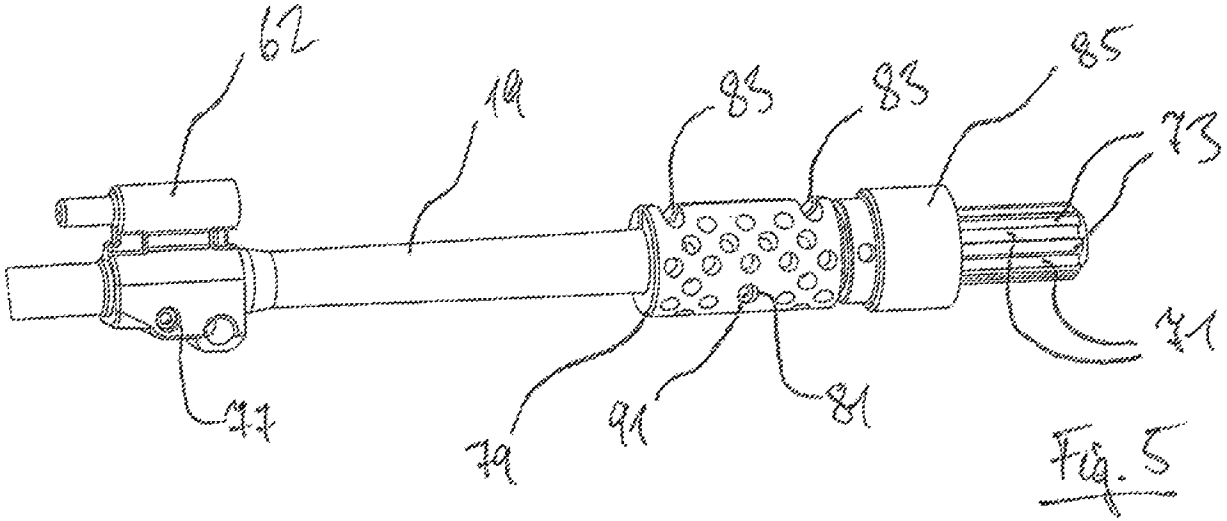
FIG. 5 is a perspective view diagonally from the front of a section of the barrel of FIG. 4*a* coupled to a secured sleeve.

The barrel 19 in FIG. 3 is shown in FIG. 4*a* with a flash suppressor 23, bayonet mount, or grenade launcher mount thereon, which is secured via a tangential pin or bolt 75, as well as the gas discharge 62, which is secured to the barrel 19 via a tangential pin 77. A sleeve 79 is secured to the barrel 19 via a tangential pin 81 at the rear end. The sleeve 79 comprises two grooves 83 (e.g., transverse grooves, recesses, etc.), extending transverse to the barrel 19, to which the adapter can be secured via tangential pins or bolts. In addition, a barrel nut 85 encompasses the barrel 19 and its barrel collar 69. The barrel nut 85 is separate from the sleeve 79, and has a section with a tapered diameter facing the sleeve 79.

FIG. 4*b* shows an alternative embodiment with an extended barrel nut 87, which has an integral sleeve section 89 on its muzzle end. The sleeve section 89 comprises two circumferential annular grooves 90, which are provided for securing the adapter 3 via tangential pins.

The sleeve 79 (FIG. 4*a*) and the sleeve section 89 (FIG. 4*b*) each have bore holes or round holes passing through them, which dissipate heat. In the illustration in FIG. 5, the sleeve 79 is secured to the barrel 19 via the tangential pin 91.

Before placing the adapter 3 on the barrel 19 and the receiver 4, the barrel 19 and the receiver 4 are first connected to one another. A barrel receiver 99 is provided for this on the receiver 4 (cf. FIGS. 6*a* and *b*), which has an outer thread on its outer surface. The barrel 19 is inserted with its end section comprising the relief grooves 71 and webs into the barrel receiver 99, and screwed to the outer thread of the barrel receiver 99 via an inner thread provided on the inner surface of the respective barrel nut 85, 87, and secured thereby. The barrel nut 85, or barrel nut 87 bears with the extended sleeve section on the barrel collar 69, and secures the barrel 19 to the barrel receiver 99.

An orientation recess 103 is provided above the barrel receiver 99, which extends transverse to the barrel 19, for receiving extensions on the adapter, or its insert component 123 (guide lugs 143, cf. FIGS. 15*a* to *d*). The gas piston rod 159 is also guided therein in the region indicated by reference numeral 175 (see FIGS. 9*b*, 10*a*, 11). A further orientation recess 107 is provided below the barrel receiver 99 for receiving the extension 54 on the lower rear end of the barrel-side section 25 of the adapter 3. This recess 107 is located in a basically triangular extension on the undersurface of the receiver 4, where the front surface of a magazine receiver 15 can be attached to its lower bolt. The upper bolt 106 is a relic of the production technology (serving originally for receiving the hand guard), and no longer serves any purpose.

A longitudinal recess 101 is provided on the upper surface of the receiver section 4*a*, into which the breechblock carrier is inserted. A base 96 with a dovetail profile is provided on the rear upper surface of the receiver section 4*a*, adjacent to the recess 101. A production depression 98 adjoins this, which is ultimately bordered by a dovetail-shaped counter-profile guide 97. When mounting the adapter 3 on the self-loading firearm 1, the receiver-side section 35 of the adapter 3 is first slid with a dovetail profile 109 on its rear end (cf. FIG. 7) onto the base 96, and then guided further, until the dovetail profile 109 has been guided into the dovetail profile of the counter-profile of the base 96 such that it moves longitudinally in the manner of a floating bearing. Because of the dual dovetail profile, the receiver-side section 35 and thus the adapter 3 are secured against lateral movements, as well as vertical movements, but can still move longitudinally. In this manner, any changes in the receiver, e.g. through thermal effects, or other deformations of the receiver 4 or the receiver section 4*a* in the longitudinal direction, can be compensated for.

Lateral hinge eyelets 93 are formed at the rear end of the receiver section 4*a*, to which the shoulder rest 5 can be secured, or folded in laterally. An eyelet is provided on the opposite side of the receiver section 4*a* (cf. FIG. 6*b*) for securing the shoulder rest, in which the shoulder rest can be attached via a bolt or tension pin, or similar attachment means.

Figure 7:
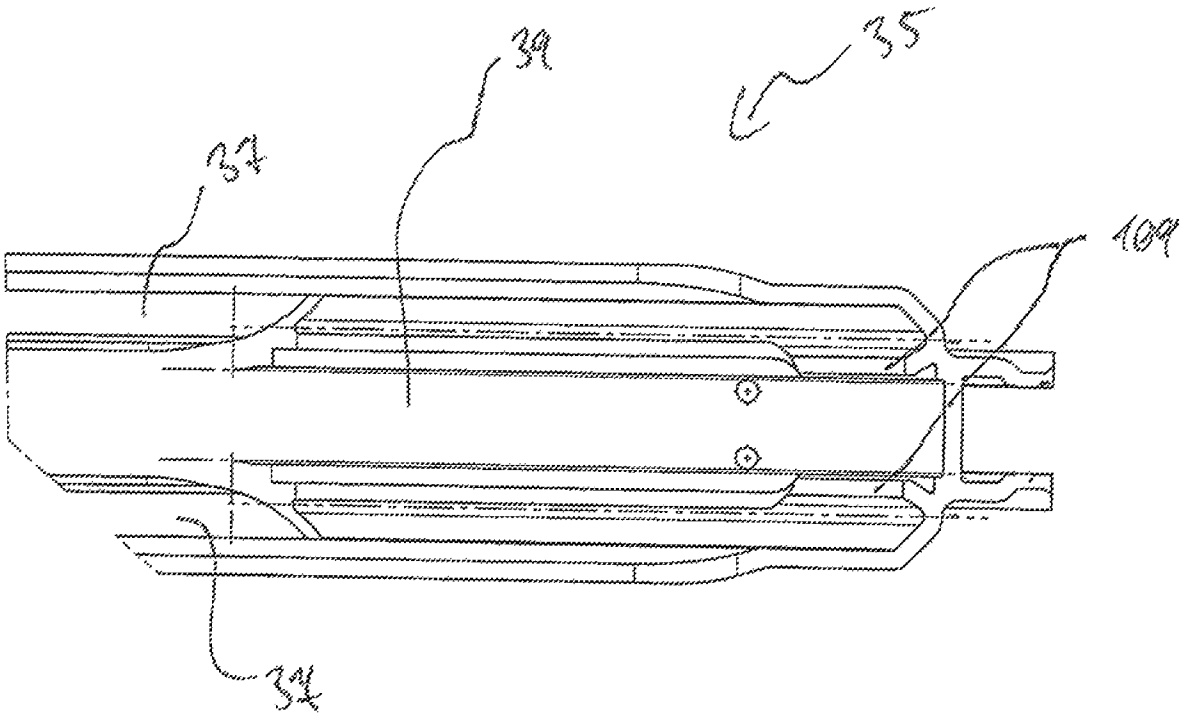
FIG. 7 is a bottom view of a receiver-side section of the adapter of FIG. 1.
Figure 8:
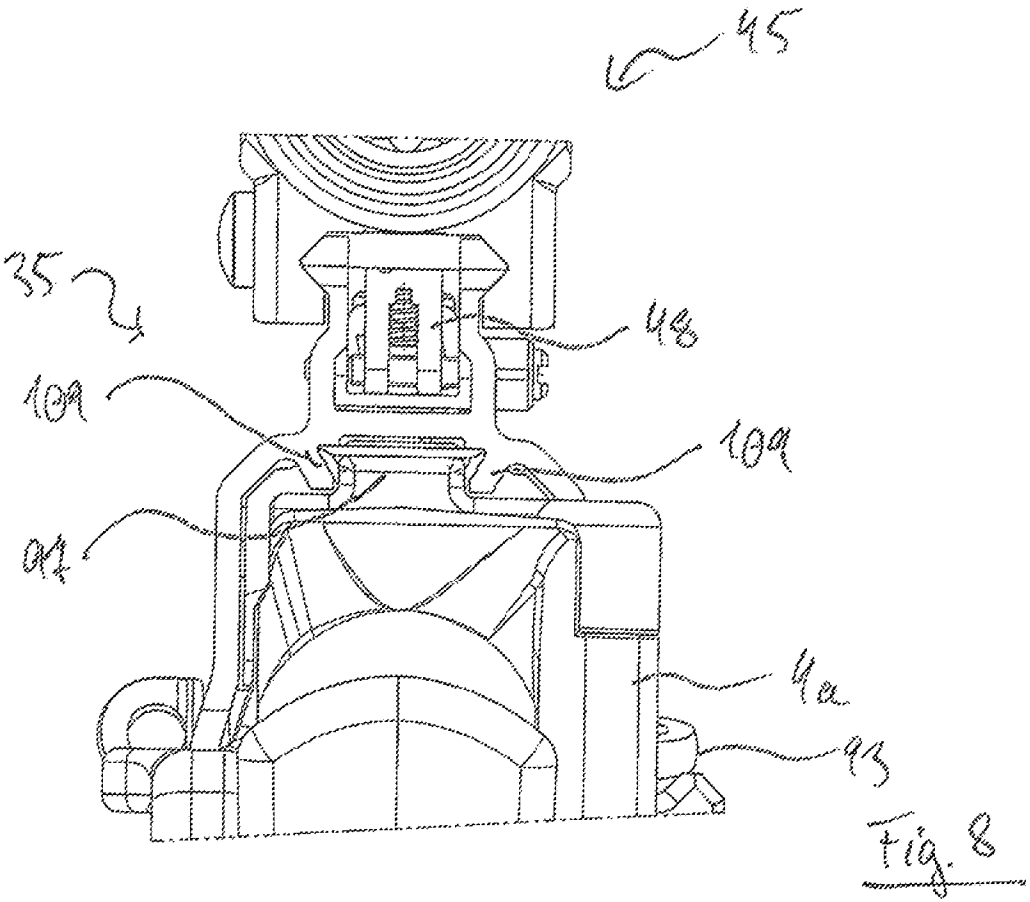
FIG. 8 is a rear view of the adapter mounted on the self-loading firearm of FIG. 1.
Figures 9A, 9B:
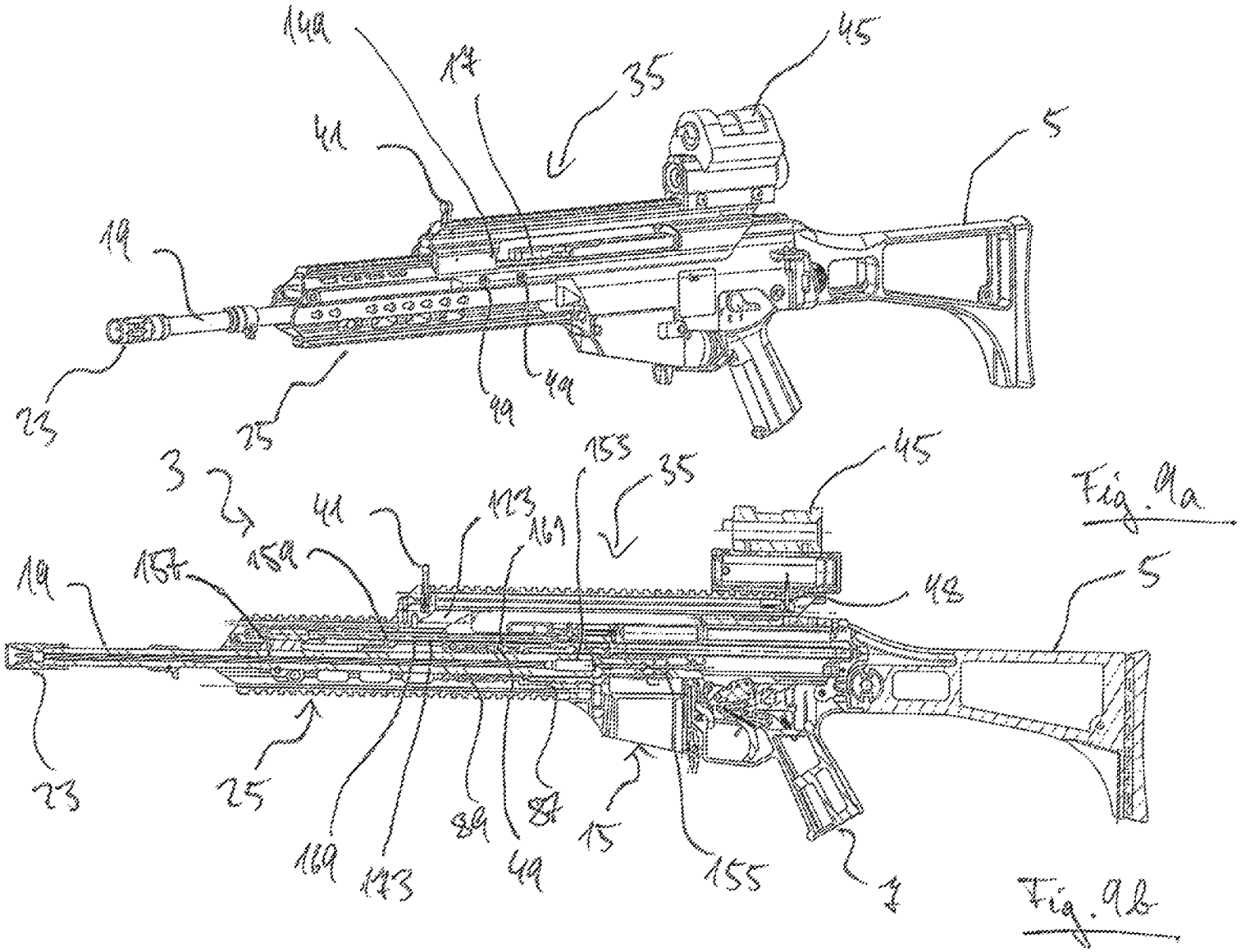
FIG. 9*a* is a perspective view diagonally from the front above of the self-loading firearm of FIG. 1.
FIG. 9*b* is a longitudinal cross-sectional view of the self-loading firearm of FIG. 1.

FIG. 7 shows a view of the undersurface of the receiver-side section 35 of the adapter 3 from above. The recesses 37 (e.g., cut-outs) for guiding the reloading lever 17, which extend on both sides of the Picatinny rail section 27, are shown therein. The extensions project with their dovetail profile at the rear end of the receiver-side section 35, which is provided for engaging in the counter-profile, or guide 97, on the receiver section 4*a*. This is shown in FIG. 8, which shows how the receiver-side dovetail profile engages in the counter-profile on the guide 97 in a rear view. Sections of the flip-up sight assembly 41 and the diopter sight 45 placed on the adapter are shown on the upper surface. The receiver-side section 35 encompasses the receiver section 4*a* to approximately the height of the eyelet for attaching the shoulder rest 5 (e.g., a pivotal shoulder rest).

FIGS. 9 to 11 show different perspectives of the adapter when it has been placed on the self-loading firearm 1 in the embodiment that has the barrel nut 87 extending over the sleeve section 89, which is screwed to the barrel receiver 99 and secured thereto. A cartridge (not shown) introduced into the chamber is fired via the firing pin 155 when the known trigger mechanism is actuated. The barrel 19 comprises a bore hole 157, through which the propellant is conducted into the gas discharge 62, in order to actuate the gas-operated reloading mechanism known from the assault rifle G36 by the applicant. A portion of the propellant released when a cartridge is fired, which has been redirected by the gas discharge, acts thereby on the gas piston rod 159, which in turn acts on the breech, in order to eject an empty casing and drive the bolt back in order to receive a new cartridge. The gas piston rod 159 is partially guided in the barrel-side section 25 of the adapter 3, as well as through the insert component 123 (cf. FIGS. 15*a* to *c*) and in section 175 of the receiver section 4*a*.

Figures 10A, 10B:
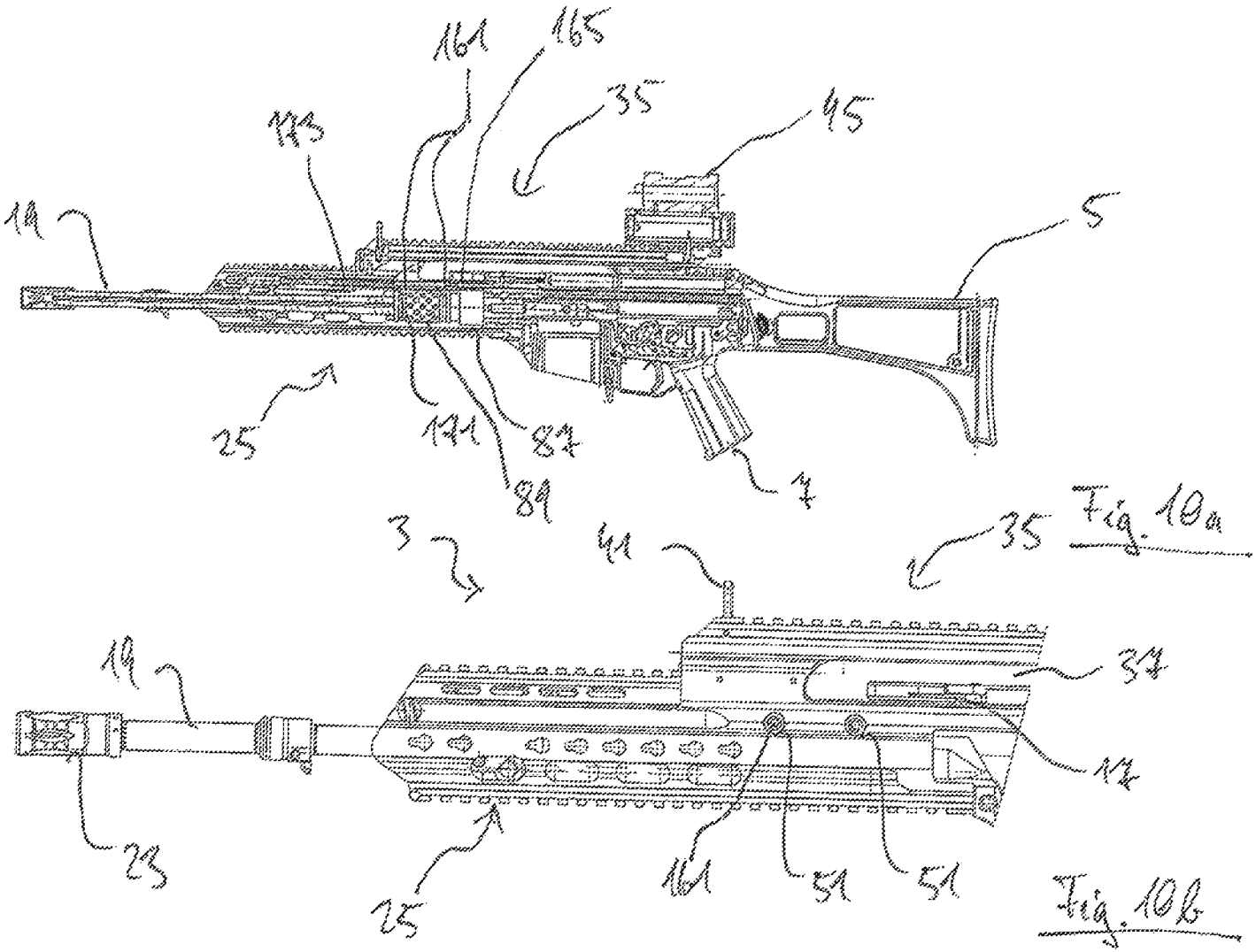
FIG. 10*a* is a longitudinal cross-sectional view of the self-loading firearm of FIG. 1 with the cross-sectional plane displaced outward.
FIG. 10*b* is a detailed lateral view of a front section of the self-loading firearm of FIG. 1.

FIGS. 10*a* and 10*b* show the tangential pins 161, with which the adapter 3 is secured in the annular grooves 90 (cf. FIG. 10*a*). In the embodiment with the separate sleeve 79, the tangential pins 161 each secure the sleeve 79 attached to the barrel 19 in their transverse grooves 83 (cf. FIGS. 4*a* and 5).

Figures 12A, 12B:
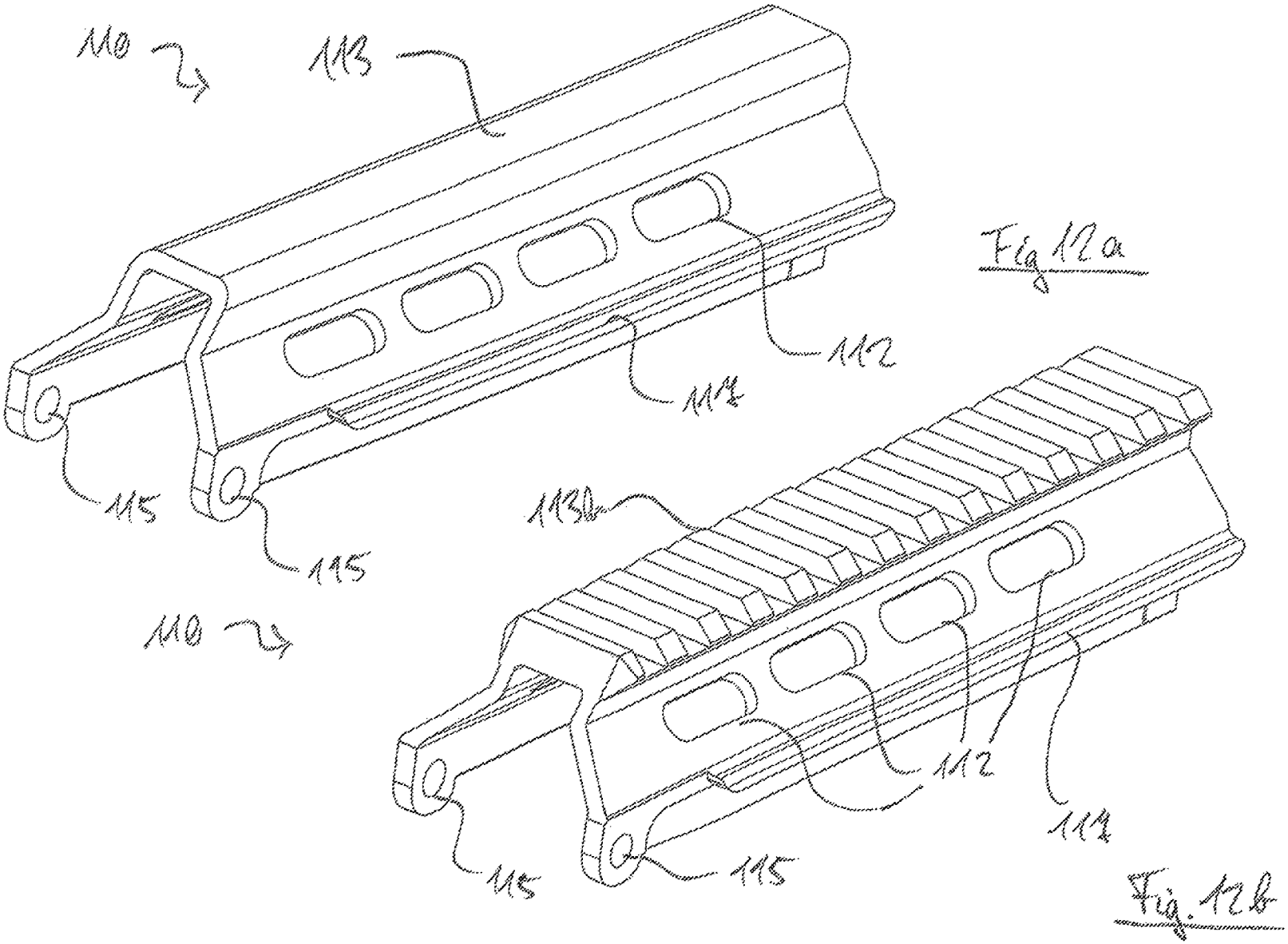
FIG. 12*a* is a perspective view of a first example cover of the adapter of FIG. 1.
FIG. 12*b* is a perspective view of a second example cover of the adapter of FIG. 1.

FIGS. 12*a* and 12*b* each show a cover 110 for use in the barrel-side section 25 of the adapter 3, in order to enable access to the gas piston rod 159 and the removal or cleaning thereof. The two embodiments of the cover 110 differ in terms of the design of the rail 113 on the upper surface, which is smooth in the embodiment according to FIG. 12*a*, and is a Picatinny rail 113*b* in the embodiment according to FIG. 12*b*. The cover 110 comprises holes 112 in each case, extending longitudinally on both sides, provided as slots, as well as holes 115 provided on both sides of its front lower end for receiving a hinge pin 119, so that it can be pivotally supported on the adapter 3. The cover 110 is initially provided with a U-shaped cross section, and transitions to a V-shape.

Figures 13A, 13B:
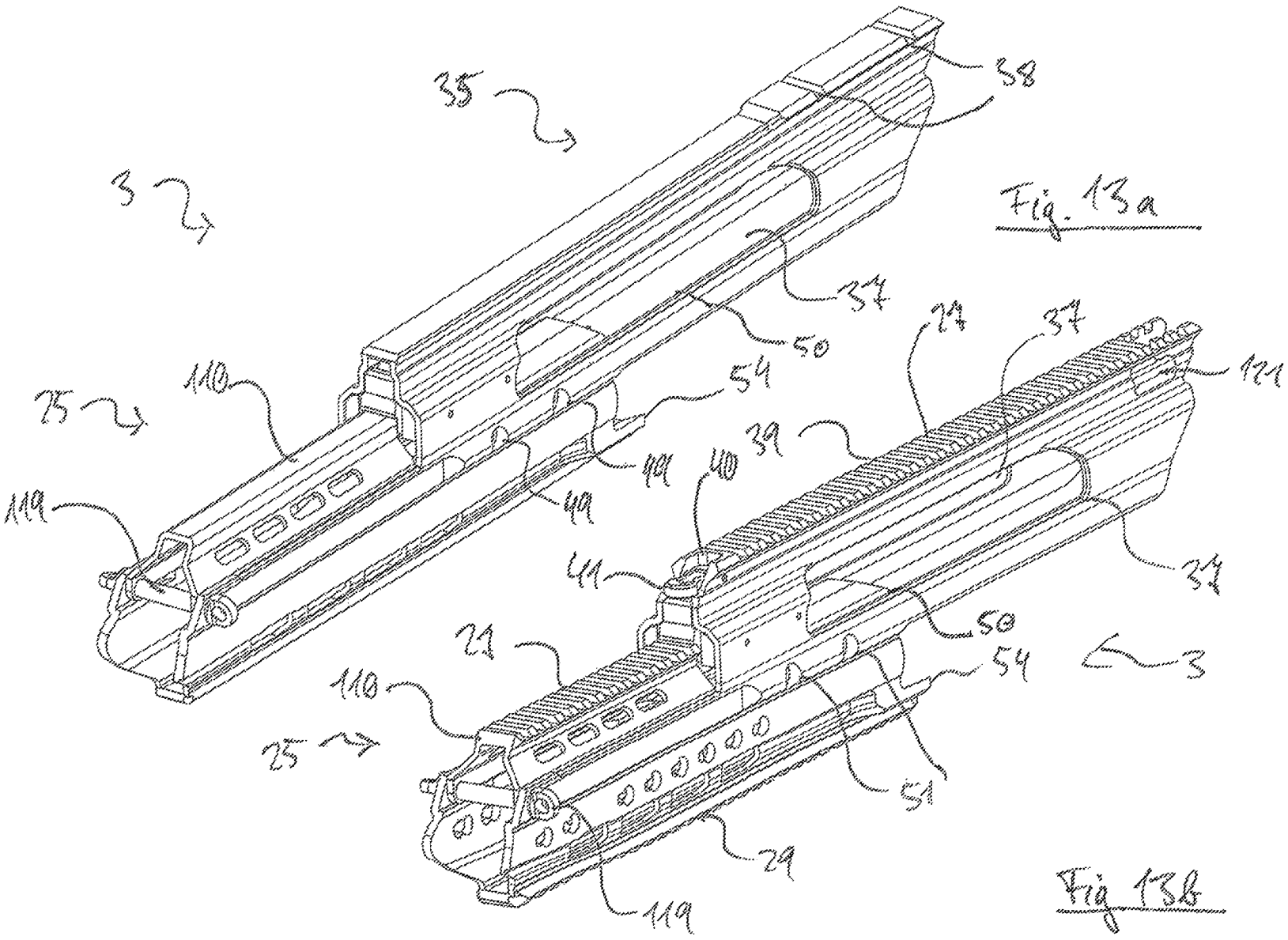
FIG. 13*a* is a perspective view diagonally from the front of the cover of FIG. 12*a* coupled to the adapter of FIG. 1.
FIG. 13*b* is a perspective view diagonally from the front of the cover of FIG. 12*b* coupled to the adapter of FIG. 1.
Figure 14:
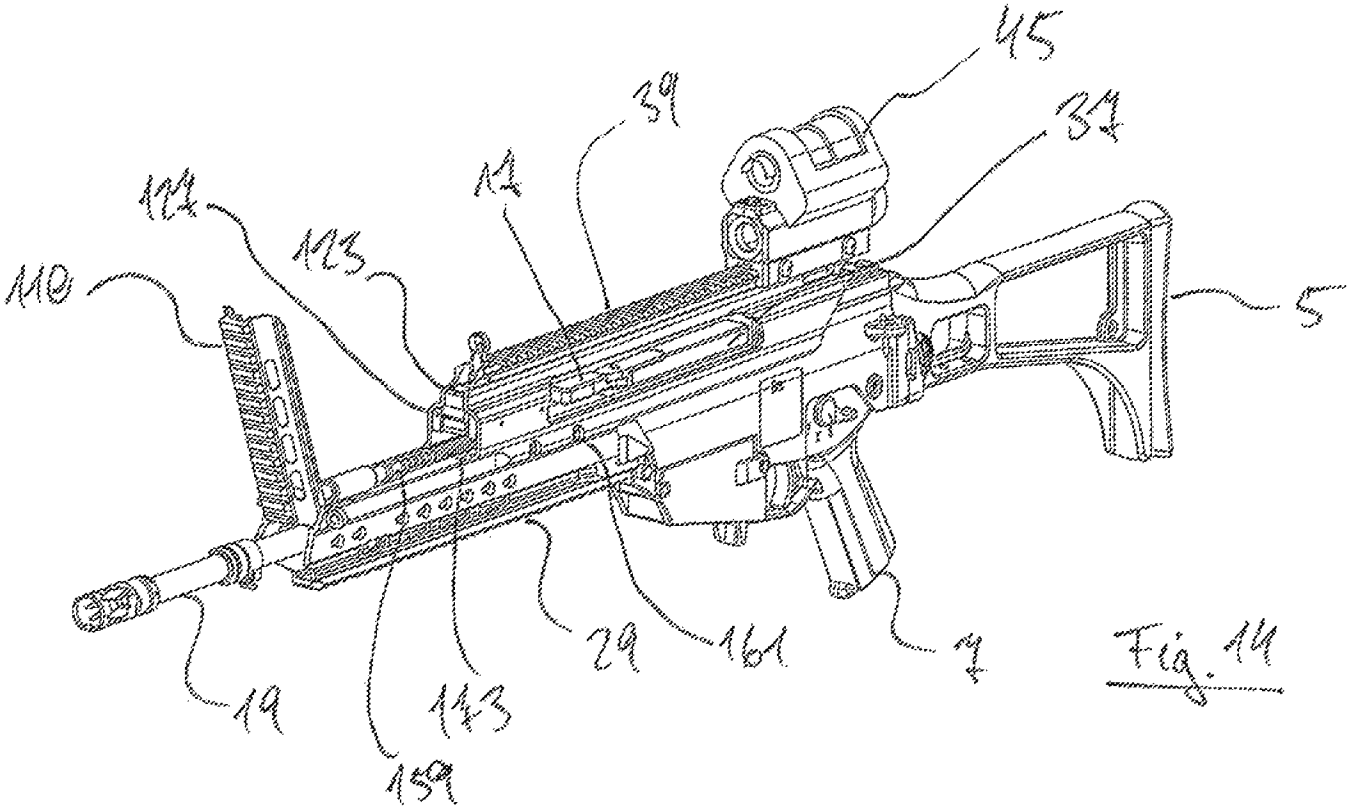

Longitudinal webs 117 extend from the lower end of the cover on both sides, which bear on counter-webs 165 (cf. FIGS. 2*a* and 2*b*) on the upper surface of the barrel-side section 25 of the adapter. FIGS. 13*a* and 13*b* each show the adapter with the cover 110 placed thereon, wherein the hinge pin 119 passes through each of the bores or holes 49 in the barrel-side section 25 as well as the holes 115 in the cover 110, and pivotally secures them. The extension 54 that is to be received in the recess 107 (cf. FIGS. 6*a* and 6*b*) in the receiver section 4*a* is provided on the lower rear end of the barrel-side section 25.

The bearing insert 121 is inserted at the rear end of the receiver-side section 35 of the adapter 3 in FIG. 13*b*. The flip-up sight 41 can be seen in the folded-in state on the upper surface on the front end of the barrel-side section in the recess 40 in the Picatinny rail 39. An insert 123 is placed below the flip-up sight (cf. FIGS. 15*a* to 15*d*), and its upper surface serves as a bearing for the flip-up sight 41.

Figure 14:
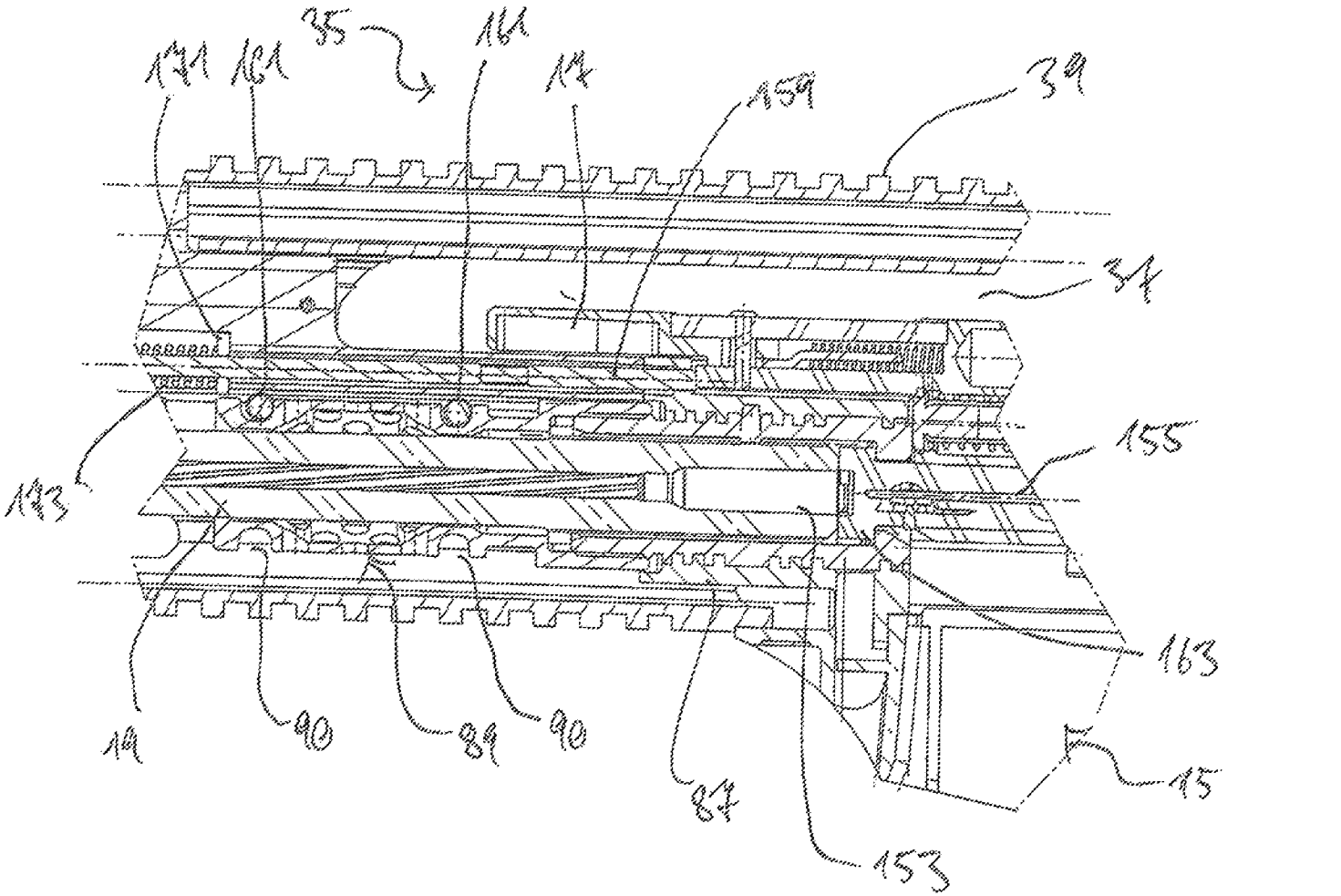
FIG. 14 is a perspective view diagonally from the front above of the firearm of FIG. 1 with the cover of FIG. 12*b* open.

FIG. 14 shows the self-loading firearm 1 with the cover 110 folded open in the embodiment with the Picatinny rails. The gas piston rod 159, together with the gas piston rod spring 167 (e.g., a helical spring) that encompasses it, can be seen inside the empty recess underneath the cover 110. In this position, the gas piston rod 159 and/or the gas piston rod spring 167 can be cleaned or removed as needed.

FIGS. 15*a*-15*d* show different details of the insert 123. This basically has three functions: first, it is used to secure the cover 110 in its closed position, second, it serves as a guide for the gas piston rod, and third, it stabilizes the bridge section 33 and thus the adapter.

Figures 15A, 15B, 15C:
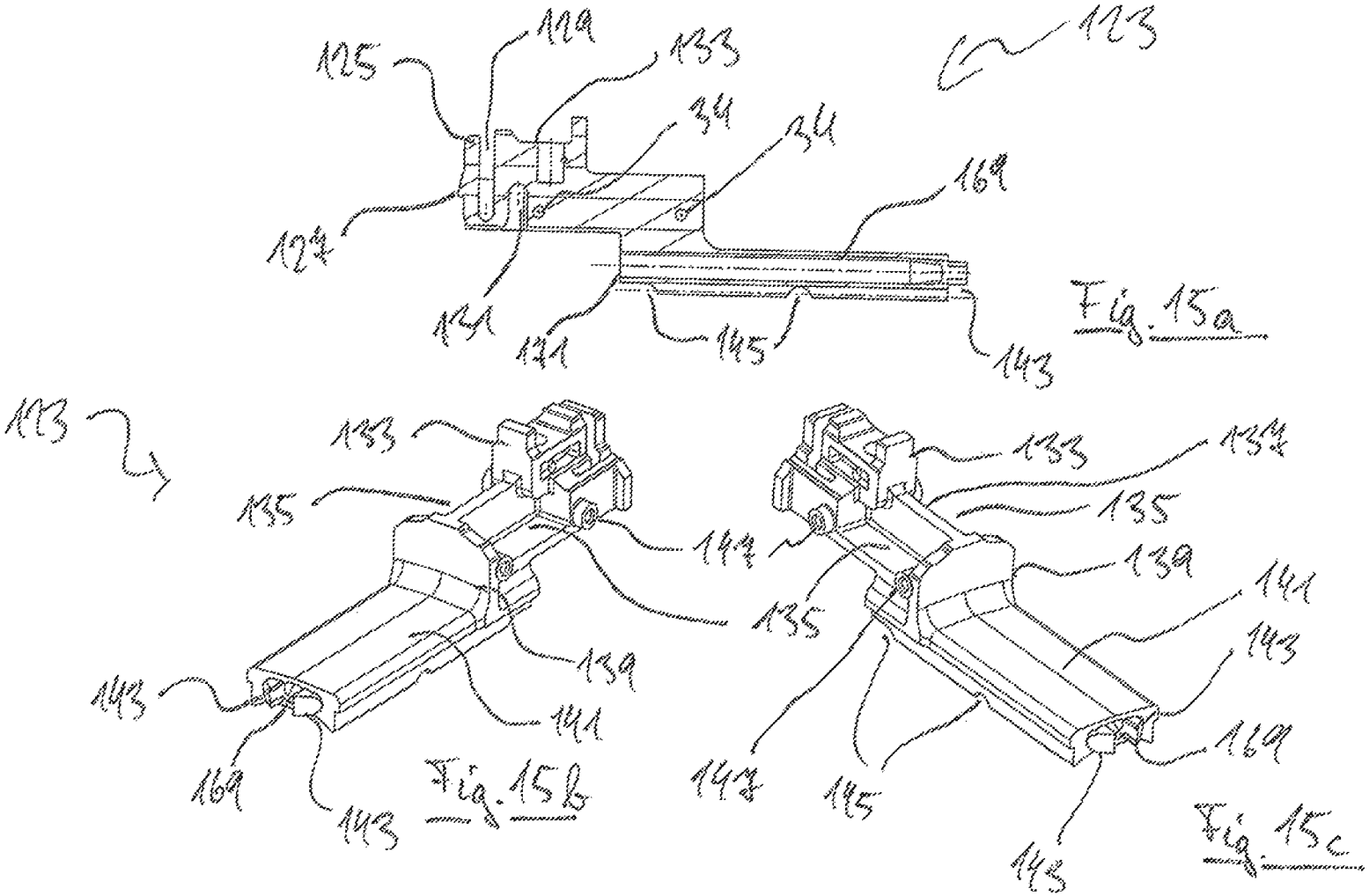
FIG. 15*a* is a longitudinal cross-sectional view of an insert.
FIG. 15*b* is a perspective view diagonally from the rear of a left side of the insert of FIG. 15*a*.
FIG. 15*c* is a perspective view diagonally from the rear of a right side the insert of FIG. 15*a*.
Figure 15C:
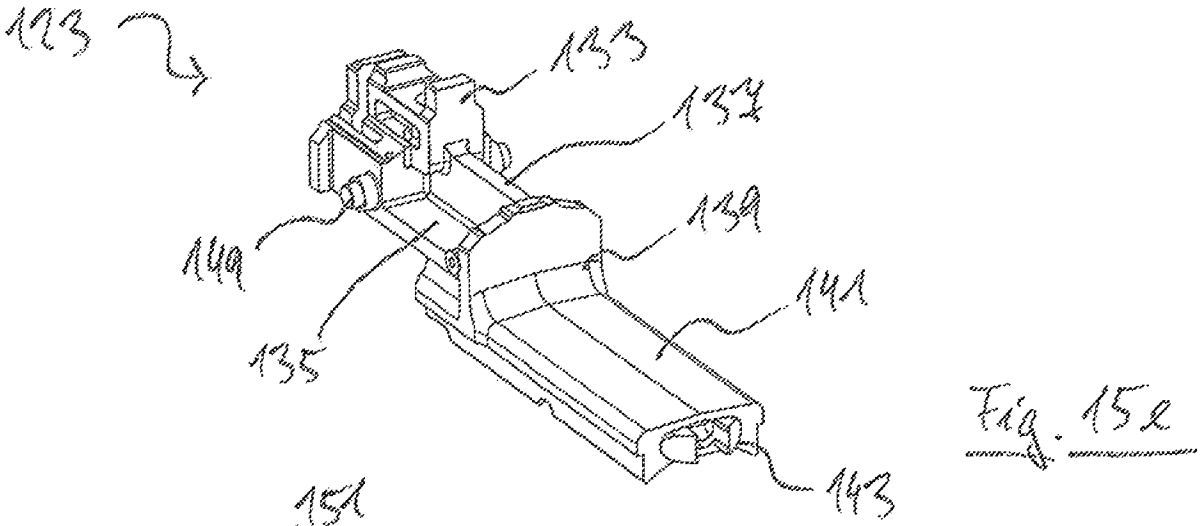

FIG. 15*a* shows a longitudinal section of the insert 123. On its front side, the insert 123 comprises a molded spring 124, which is elastically attached via recesses 129 and 131 to the insert component 123. In the closed position of the cover 110, it is snapped with its rear upper surface into a transverse molded spring latching lip or lug 127 extending forwards on the molded spring 125. In this position, the cover 110 is snapped and retained under tension in place. The insert component can preferably be integrally formed thereon, or molded from plastic, due to its shape, such that the molded spring 125 is integrated in the insert 123, e.g. as an injection molded plastic component. Alternative shapes of the insert component and its molded spring 125, as well as different materials, e.g. metal or metal/plastic composites can also be used. The molded spring 125 can also be formed as a separate detachable part, and then attached to the insert component 123 via suitable attachment means.

In the assembled state, the insert component 123 can be mounted at the front upper end of the barrel-side section 25 of the adapter 3 by means of transverse pins or transverse bolts, which can be spring-loaded, for example, for a simple assembly and dismantling. The front spring-loaded traverse bolt 149 (cf. FIG. 9*a*) pass through pin holes or holes 147 (e.g., cut-outs) on the insert component 123 that are aligned with pin holes or holes 34 on the adapter 3. A web 137 extends above the holes 147 (e.g., pin holes, cut-outs, etc.), basically in the middle of the insert component in the longitudinal direction, which borders recesses 135 on both sides as a result of the production process, in order to simplify the design of the insert component 123. An attachment 133 is provided on the front upper end of the longitudinal web 137, which basically extends to the molded spring 125, has an integral design, and forms a counter-bearing for the flip-up sight 41 on its upper surface. A bolt-spring construction (not shown) for snapping the flip-up sight into its upright and folded-down positions is provided therein.

The insert is arched at the rear end of the longitudinal web 137, with a stepped surface extending to the back, in a basically rectangular longitudinal section 141. A longitudinal gas piston rod guide 169 for guiding the gas piston rod 159 is provided in approximately the middle of this rectangular longitudinal section 141 (cf. FIGS. 9*b*, 10*a*, and 11). The gas piston rod guide tapers at its front end facing the gas discharge 62, and thus forms a counter-bearing 171 for supporting a gas piston rod spring 173 (cf. FIGS. 9*a*, 10*a*, and 11). Two guide lugs 143 for centering the insert and the gas piston rod guide 169 in the direction of the receiver 4 are disposed at the rear end of the insert 123. When the adapter 3 is slid onto the receiver 4 (e.g., a breech-guiding receiver) and snapped in place, the guide lugs 143 engage in the orientation recess 103 (cf. FIGS. 6*a* and 6*b*) on the front surface of the receiver 4, above the barrel receiver 99. In this manner, the gas piston rod guide 169 can be centered and aligned with an extension of the gas piston rod guide in section 175 of the receiver 4.

Recesses 145 (e.g., semi-circular transverse grooves) are provided on the undersurface of the insert component 123 in the form of semi-circular transverse grooves extending transverse to the insert component 123. When the adapter is secured to the sleeve 79 or the sleeve extension 89 on the barrel nut 87 (cf. FIGS. 4*a* and *b*, and 5) by means of the tangential pins and/or transverse screws (cf. FIG. 11), the tangential pins or transverse screws pass through holes 49 and also pass through the semi-circular transverse grooves 145. If transverse screws are used in holes 49, their heads are located on one side of the adapter 3, and are anchored in threaded parts in metal fixtures on the other side of the adapter 3, such that when the transverse screws are tightened, the adapter 3 is secured in a form-fitting and force-fitting manner to the sleeve or the circumferential annular grooves 90 via the transverse grooves 83, and secured via a clamping force between the receiver 4 and adapter 3, and the sleeve 79 or sleeve extension 89 on the barrel nut 87.

Figure 15D:
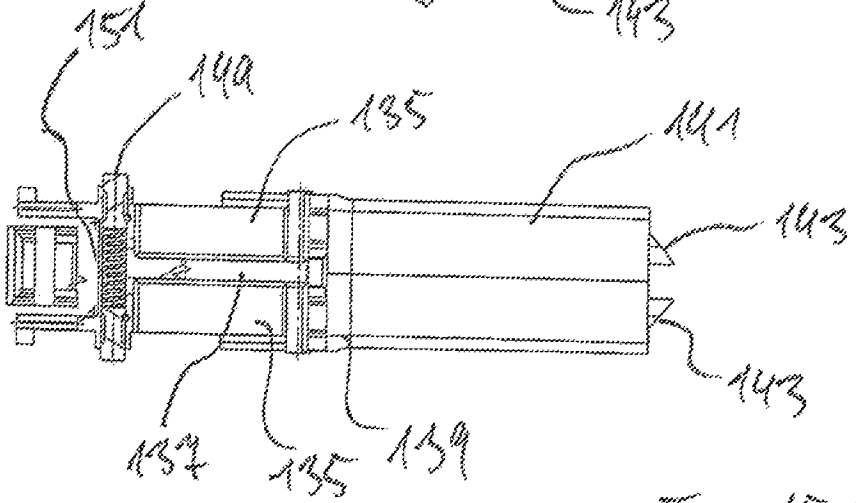
FIG. 15*d* is a top cross-sectional view of the insert of FIGS. 15*a*-15*c*.

FIG. 15*d* shows a cross sectional view of the insert 123 from above, cut through the front spring-loaded transverse bolt 149, which is tensioned outward by a helical spring 151. When the insert 123 is inserted in this embodiment, the front spring-loaded transverse bolt 149 can be inserted into the adapter 3.

Figure 16:
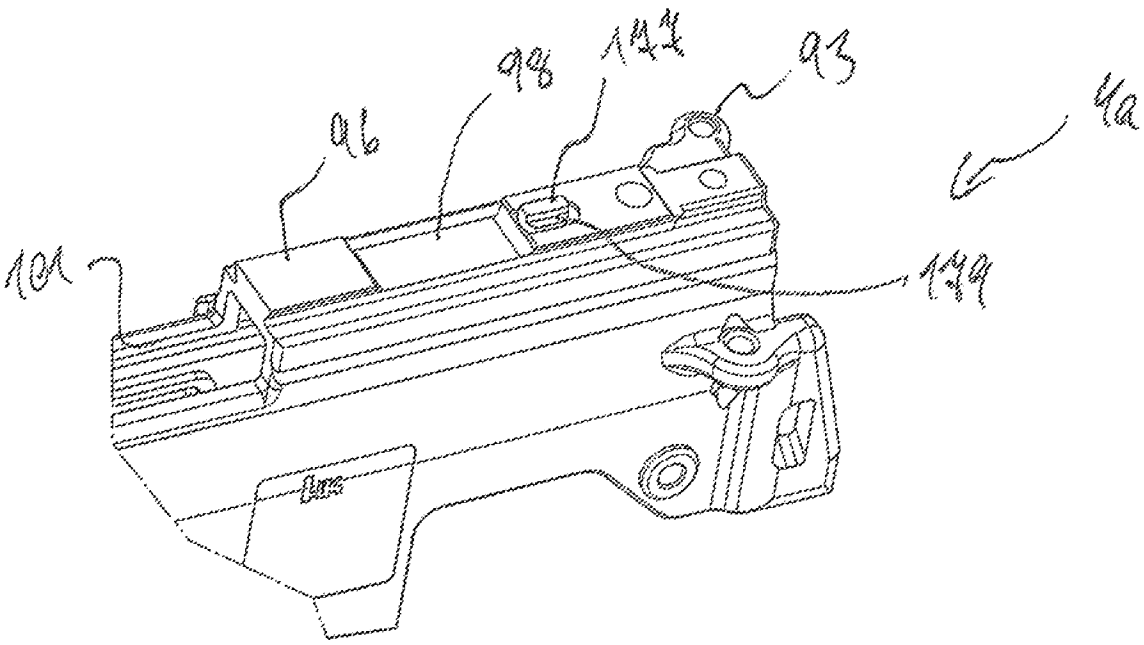
FIG. 16 is a perspective view of a section of a receiver with a first example counter-profile.
Figure 14:
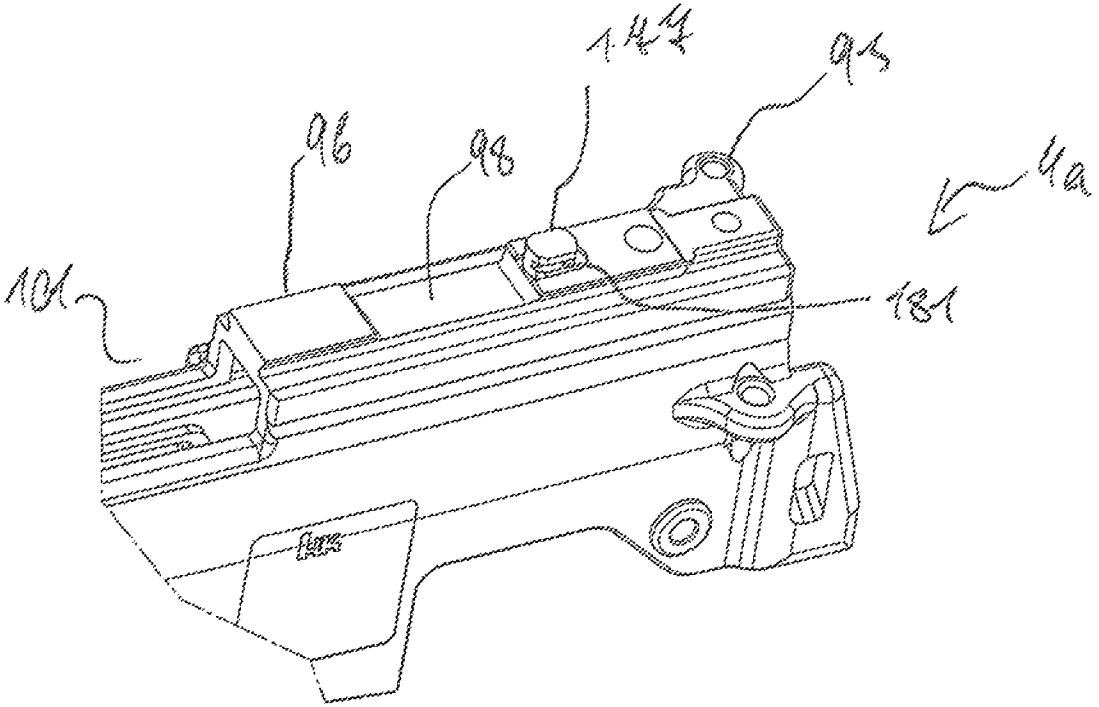

FIGS. 16 and 17 show perspective partial views of the receiver section 4*a*. A base 96 with a counter-profile is provided on the front upper end of the receiver section 4*a*, over which the dovetail profile 109 is slid during assembly, and then slides over the subsequent, basically rectangular production depression 98. In the embodiment according to FIGS. 16 and 17, instead of the integral floating bearing counter-profile of the guide 97 in FIGS. 6*a* and *b*, the floating bearing counter-profile 177 is provided as a separate component. This can be made of metal or a metal/plastic composite, and attached to the receiver section 4*a* in a suitable manner. Alternatively, this separate component can also be glued to the receiver 4.

The floating bearing counter-profile 177 also comprises a counter-profile for a complementary engagement in the dovetail profile 109. The contact surfaces of the floating bearing counter-profile 177 are spherical, in order to keep the contact surfaces, and thus also the mechanical torques, as low as possible. In the embodiment according to FIG. 16, the separate component of the floating bearing counter-profile 177 passes through two basically V-shaped or wedge-like transverse grooves 179, which extend in approximately the middle of the upper surface over the entire width of the floating bearing counter-profile 177. In the embodiment according to FIG. 17, the transverse groove 181 forms a slot, and likewise extends through approximately the middle of the floating bearing counter-profile 179 over its entire width. The bearing of the dovetail profile 109 is basically linear, such that the overall bearing surface is reduced.

A generic adapter disclosed herein thus has the additional following features: one of the barrel-side section and the receiver-side section is securable to a retention device on a firearm barrel or a firearm receiver, and wherein the other of the barrel-side section and the receiver-side section can be moveably supported on the firearm receiver or the firearm barrel by a guide (e.g., a floating bearing) that allows for longitudinal movement of the receiver-side section or the barrel-side section with respect to the firearm.

This patent arises from an application that is a continuation of International Patent Application PCT/EP2016/001780, which was filed on Oct. 26, 2016, which claims priority to German Patent Application Serial Number DE 10 2015 013 803.0, which was filed on Oct. 26, 2015. DE Patent Application Serial Number 10 2015 013 803.0 and International Patent Application PCT/EP2016/001780 are incorporated by reference herein in their entirety.

What is claimed is:

1. An adapter to attach at least one device to a self-loading firearm, the adapter comprising:

a barrel-side section secured to circumferential annular grooves of a retention device, the retention device secured to a barrel of the firearm; and a receiver-side section adjacent the barrel-side section, wherein the barrel-side section and the receiver-side section extend in a longitudinal direction of the firearm;

wherein when the barrel-side section is secured to the retention device, the receiver-side section can be supported on a firearm receiver by a guide that allows for longitudinal displacement of the receiver-side section with respect to the firearm.

2. The adapter according to claim 1, wherein the barrel-side section and the receiver-side section are unitary.

3. The adapter according to claim 1, wherein the barrel-side section at least partially encompasses the firearm barrel as a hand guard, and the receiver-side section at least partially covers an upper surface of the firearm receiver.

4. The adapter according to claim 3, wherein, after assembly of the adapter on the firearm, the barrel-side section extends along the firearm barrel from proximity of a gas discharge to the firearm receiver and encompasses the firearm barrel without contacting the firearm barrel.

5. The adapter according to claim 1, wherein the receiver-side section comprises one or more grooves on at least one of an upper surface or a lateral surface, and wherein the barrel-side section comprises one or more grooves on an under surface, the grooves for attaching at least one additional device.

6. The adapter according to claim 1, wherein a Picatinny rail at least partially forms at least one of an upper surface or a lateral surface of the receiver-side section, and wherein a Picatinny rail at least partially forms an under surface of the barrel-side section.

7. The adapter according to claim 1, wherein the barrel-side section transitions into the receiver-side section via at least one lateral bridge section, and wherein the at least one lateral bridge section is a stepped section.

8. The adapter according to claim 1, wherein the barrel-side section and the receiver-side section comprise one or more holes on a first lateral surface and a second lateral surface opposite the first lateral surface, and wherein the one or more holes are for inserting attachment means.

9. The adapter according to claim 1, wherein the barrel-side section and the receiver-side section comprise one or more lateral holes.

10. The adapter according to claim 1, wherein at least one of the barrel-side section or the receiver-side section comprises one or more projecting extensions on a rear surface to guide, center and secure the adapter on the firearm.

11. The adapter according to claim 10, wherein the one or more projecting extensions of the receiver-side section comprises a dovetail profile.

12. The adapter according to claim 1, wherein the receiver-side section comprises one or more longitudinal recesses on a first lateral surface and a second lateral surface to actuate a reloading lever.

13. The adapter according to claim 1, wherein the receiver-side section comprises one or more recesses to support at least one adjustable sight, and wherein the at least one adjustable sight is at least one of a flip-up rear sight assembly or a flip-up front sight.

14. The adapter according to claim 1, wherein the barrel-side section comprises a cover pivotable between an open position and a closed position about a hinge axis.

15. The adapter according to claim 7, wherein the adapter comprises an insert coupled to the at least one lateral bridge section to stabilize and reinforce the adapter.

16. The adapter according to claim 15, wherein the insert comprises an elastic element, and wherein the elastic element comprises a latching lug to secure a cover to the insert.

17. The adapter according to claim 16, wherein the elastic element is provided integrally with the insert, and wherein the elastic element is one of a molded spring or a separate component.

18. The adapter according to claim 15, wherein the insert comprises at least one of a longitudinal gas piston rod guide or a bearing to support a gas piston rod spring.

19. The adapter according to claim 15, wherein a rear surface of the insert comprises at least one guide element to guide and center the insert on a receiver during assembly.

20. A self-loading firearm, comprising:

an adapter, comprising:

a barrel-side section; and a receiver-side section adjacent the barrel-side section, wherein the barrel-side section and the receiver-side section extend in a longitudinal direction of the firearm;

wherein when the barrel-side section is secured to a retention device on a firearm barrel, the receiver-side section can be supported on a firearm receiver by a guide that allows for longitudinal displacement of the receiver-side section with respect to the firearm, the guide positioned on the firearm receiver;

a retention device coupled to the barrel-side section to secure the adapter, the retention device including grooves; and a floating bearing positioned on the guide and to be coupled to the receiver-side section to allow longitudinal displacement of the adapter with respect to the firearm.

21. The firearm according to claim 20, wherein the retention device is one of a sleeve or an integral sleeve-like extension section of a barrel nut, and wherein the sleeve is securable to the barrel-side section in a region of the barrel nut.

22. The firearm according to claim 20, wherein the receiver-side section comprises at least one counter-profile to receive at least one of the guide or an insertion element of the adapter.

23. The firearm according to claim 22, wherein the at least one counter-profile is complementary to a dovetail profile of an extension, and wherein the extension comprises a bearing to allow longitudinal movement of the extension with respect to the firearm.

24. A firearm adapter comprising:

a barrel-side section including holes that extend horizontally through the barrel-side section to couple the barrel-side section to a retention device on a barrel of a firearm, the barrel-side section including a parallel extension on a rear surface; and a receiver-side section positioned opposite the parallel extension, the receiver-side section including a recess to receive a guide of a receiver of the firearm to allow longitudinal displacement of the receiver-side section with respect to the firearm.

25. The firearm adapter of claim 24, wherein the holes are to receive fasteners, the fasteners to couple the barrel-side section to a sleeve on the barrel of the firearm.

* * * * *